US006595791B2

(12) United States Patent
Below et al.

(10) Patent No.: US 6,595,791 B2
(45) **Date of Patent: *Jul. 22, 2003**

(54) INDUSTRIAL TELECOMMUNICATIONS CONNECTOR

(75) Inventors: Randy J. Below, Cheshire, CT (US); Arthur D. Bauer, Southington, CT (US); Ronald T. Briggs, Jr., Waterbury, CT (US); Joseph D. Bucciaglia, Oxford, CT (US); Robert C. Carlson, Sr., Thomaston, CT (US); Frederick W. Mitchell, III, Torrington, CT (US); Michael A. Salvietti, Oakville, CT (US); John A. Siemon, Woodbury, CT (US)

(73) Assignee: The Siemon Company, Watertown, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/208,345

(22) Filed: Jul. 30, 2002

(65) Prior Publication Data

US 2002/0187669 A1 Dec. 12, 2002

Related U.S. Application Data

(63) Continuation of application No. 09/873,896, filed on Jun. 4, 2001, now Pat. No. 6,475,009.
(60) Provisional application No. 60/209,135, filed on Jun. 2, 2000.

(51) Int. Cl.[7] ..... H01R 13/52
(52) U.S. Cl. ..... 439/271; 439/676; 439/344

(58) Field of Search ..... 439/271, 676, 439/344, 521, 641–654, 272–277, 278–283, 587–589

(56) References Cited

U.S. PATENT DOCUMENTS

| | | | | |
|---|---|---|---|---|
| 2,605,315 | A | 7/1952 | Hargett | 439/275 |
| 3,816,664 | A | 6/1974 | Iversen | 174/76 |
| 3,840,839 | A | 10/1974 | Smaczny et al. | 439/294 |
| 3,963,297 | A | 6/1976 | Panek et al. | 439/204 |
| 4,361,374 | A | 11/1982 | Marmillion et al. | 439/314 |
| 4,367,002 | A | 1/1983 | Waghorn et al. | 439/314 |
| 4,545,633 | A | 10/1985 | McGeary | 439/141 |
| 4,705,339 | A | 11/1987 | Hayes et al. | 439/277 |
| 4,795,360 | A | 1/1989 | Newman et al. | 439/278 |
| 5,098,310 | A | 3/1992 | Avramovich et al. | 439/282 |
| 5,176,534 | A | 1/1993 | Nozick | 439/402 |
| 5,484,301 | A | 1/1996 | Koumatsu et al. | 439/271 |
| 5,564,951 | A | 10/1996 | Attal et al. | 439/676 |
| 5,618,204 | A | 4/1997 | Nix et al. | 439/559 |
| 5,823,811 | A | 10/1998 | Blanchfield et al. | 439/274 |
| 5,906,513 | A | 5/1999 | Peterson et al. | 439/607 |
| 2001/0036762 | A1 | 11/2001 | Payson et al. | 439/320 |

FOREIGN PATENT DOCUMENTS

EP WO 01/01522 A2 1/2001

*Primary Examiner*—P. Austin Bradley
*Assistant Examiner*—Ross Gushi
(74) *Attorney, Agent, or Firm*—Cantor Colburn LLP

(57) ABSTRACT

A telecommunications connector including seal members for preventing contaminants from entering the plug and/or jack when mated. The mated combination of the plug and jack assemblies creates a telecommunication connector that seals and isolates the contact interface of a modular plug and a jack from contaminants such as water, dust, and other non-desirable elements and/or substances.

19 Claims, 39 Drawing Sheets

FIG. 8A
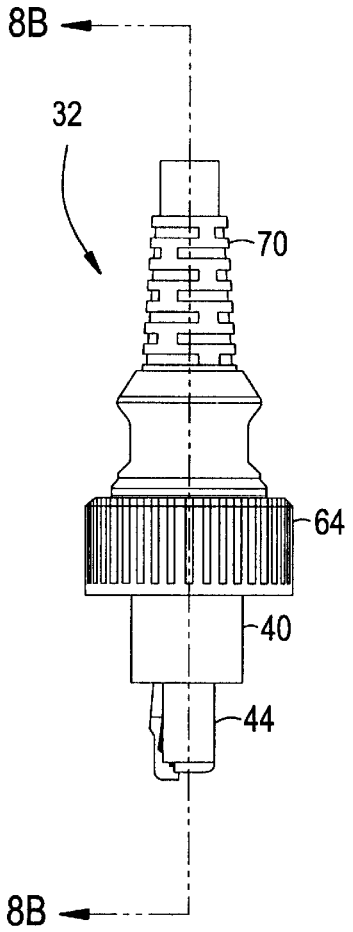
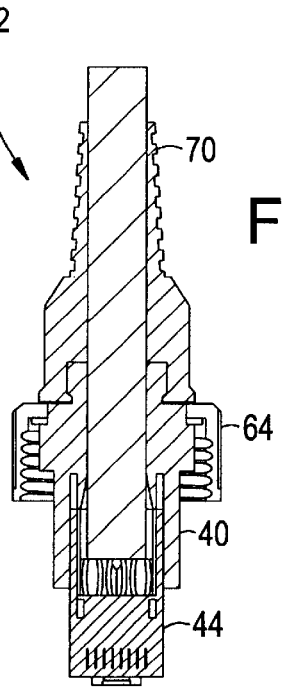
FIG. 8B
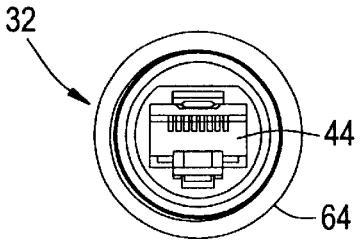
FIG. 8C

INDUSTRIAL TELECOMMUNICATIONS CONNECTOR

CROSS-REFERENCE TO RELATED APPLICATIONS

This application is a continuation of U.S. patent application Ser. No. 09/873,896 filed Jun. 4, 2001, now U.S. Pat. No. 6,475,009, the entire contents of which are incorporated herein by reference, which claims the benefit of U.S. provisional application Ser. No. 60/209,135 filed Jun. 2, 2000, the entire contents of which are incorporated herein by reference.

BACKGROUND OF THE INVENTION

The ability to quickly access critical industrial and manufacturing process information is becoming increasingly important in the information age. Recently, various Ethernet networks have been modified to access information in the industrial setting. These systems were found sufficient for their respective uses when generally located in benign environmental locations away from the industrial work space, i.e. off the plant floor. However, with associated manufacturing and industrial advances, the need has arisen to access particular information in harsh industrial environments, thus requiring rugged, industrialized Ethernet hardware which can withstand chemicals, dust, water, temperature changes, etc., common to industrial settings.

Many prevalent Ethernet and other network applications specify the use of an RJ-45 connector which is considered by some to lack the durability required for withstanding harsh industrial applications. The ability to completely protect the RJ-45 modular jack and modular plug contact interface from moisture and other hazards prevalent in the industrial setting has been addressed previously by manufacturers. These systems have relied on the use of silicon gel disposed proximate to the contact interface. The entrapment of foreign debris (dust and dirt) into the silicon gel of this system is common, such debris interfere with proper connectivity. There is a tendency for the silicon gel to trap debris between the contacts upon reinsertion of the plug into the jack. In addition, these products are not IP65 or IP67 rated and do not provide acceptable resistance to chemicals, vibration, shock and UV light.

The need for a reliable, sealed RJ-45 connector that can consistently and easily mate and unmate in an industrial setting is required. Such a product would allow for the proliferation of Ethernet and other network applications to the factory floor. Manufacturers require more information from their manufacturing equipment to determine when the equipment is operational and to understand how to improve efficiencies. Modern equipment contains numerous sensors and information generating input/output devices. These devices produce significant amounts of data that can be analyzed to improve the efficiency of the equipment. The extension of a network to the factory floor is a natural progression for companies provided the equipment and connectors used on the factory floor can withstand the harsh industrial environment.

FIGS. 1A–1C show various views of a conventional jack 10 used in industrial Ethernet applications. A front of the conventional jack 10 includes a plug receptacle 12 formed integrally therein and a rear includes a contact plate 14. The jack 10 typically engages a housing device 38 (FIG. 3) located in an Ethernet system by meshing a rear threaded portion 16 of the jack 10 with a portal 36 formed in the housing device 38.

Jack 10 includes a front threaded portion 18 for receiving a plug 20 shown in FIGS. 2A–2B. Plug 20 includes an RJ-45 plug 22 formed integrally on a front side. A threaded collet 24 is disposed about the RJ-45 plug 22 for mating with the front threaded portion 18 of the jack 10.

The jack and the plug of FIGS. 1A–1C and 2A–2B, respectively, are traditionally used in industrial Ethernet applications where the hardware of the system is prone to encounter harsh environments. The user must first mate the plug 20 into the plug receptacle 12 and then thread the threaded nut 24 onto the threads 18 of the jack 10. This dual action requires additional time and is subject to cross threading of the threads that leads to higher costs and field failures.

Harsh environments typical to industrial Ethernet applications often expose hardware to potentially degrading elements. When mated, jack 10 and plug 20 are sealed together, if at all, by the effect of collet 24 engaging front threaded portion 18. This engagement is permeable to the degradable elements and, thus, the integrity of the resulting connection is threatened.

The jack and the plug of FIGS. 1A–1C and 2A–2B are also difficult for a user to connect, disconnect, maintain, and repair. Neither the jack nor the plug are keyed to facilitate ease of mating. Integral construction does not allow maintenance or repair of the RJ-45 plug, thus necessitating disposal of the plug 20 upon malfunction. Also, the latch of the RJ-45 plug is in an active state, that is, the latch fastens with the plug receptacle of the jack during mating thus complicating and burdening the removal of the RJ-45 plug from the receptacle.

The jack and plug are also disadvantageous due to the mating arrangement therebetween. As mentioned, the connector and plug are mated by threadingly engaging the collet 24 and front threaded portion 18. In mating the connector and the plug as such, a user is prone to over-tighten or under-tighten the threaded collet about the front threaded portion. Over-tightening of the collet may impart a strain upon the connector, the plug, or the contacts, causing damage thereto. Under-tightening of the collet on the connector may improperly seal the plug and the connector and thus allow the degradable elements found in industrial Ethernet applications to enter the assembly and threaten the integrity of the connection. Both over-tightening and under-tightening the collet vary the final disposition of the RJ-45 plug within the receptacle thus increasing the potential for a faulty connection. Additionally, if a sealing element is used between the connector and plug, the variability inherent to screw-tightening the plug and connector results in inconsistent seal compression and thus resulting in improper sealing and potentially deforming or otherwise damaging the sealing element.

The jack and the plug of FIGS. 1A–1C and 2A–2B are further disadvantageous because the plug receptacle 12 opens to receive the plug at a surface flush with the beginning of the threads 18. That is, the jack in no way protects, shields, or covers the receptacle open nor does the jack provide an area for mating and sealing the jack and plug.

Accordingly, it is desirable to have an industrial telecommunications connector which provides an operable, consistent connection in harsh environments while allowing ease of use, maintenance, and repair.

SUMMARY OF THE INVENTION

An industrial telecommunications connector is provided. In one embodiment, the connector is an Industrial Grade Ethernet (RJ45 Modular Plug and Modular Jack) connector, which is environmentally sealed to facilitate telecommunications connection in harsh industrial environments.

The connector includes of a plug assembly and a jack assembly. The jack assembly is mounted into a portal of a connector housing, wherein the jack assembly receives the plug assembly to enable telecommunication connection. The mated combination of the plug and jack assemblies creates a telecommunication connector that seals and isolates the contact interface of a modular plug and a jack from water (IPX6 and IPX7), dust (IP6X), and other non-desirable elements and/or substances.

The device of the invention is used in industrial applications; including hospitals, manufacturing, and automation environments, where exposure to sunlight, moisture, chemical cleaners, and dust are commonplace. In addition, the device of the invention provides protection against shock, vibration and temperature extremes, which are all present to some degree in industrial environments.

BRIEF DESCRIPTION OF THE DRAWINGS

Referring now to the drawings wherein like elements are numbered alike in the several FIGURES:

FIGS. 4–10 are various views of a plug assembly of the industrial telecommunications connector of FIG. 3;

DETAILED DESCRIPTION OF THE PREFERRED EMBODIMENTS

Figure 1A:
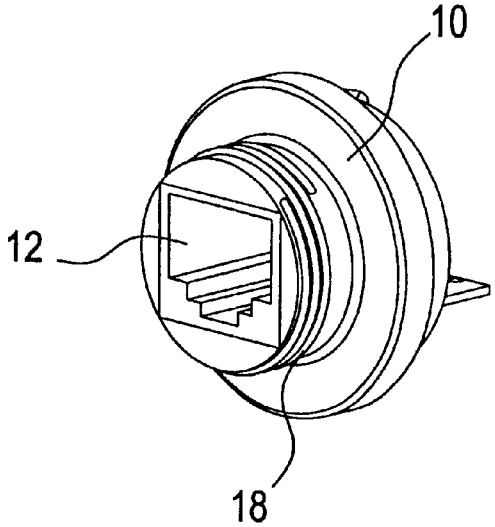
FIGS. 1A–1C are various views of a conventional telecommunications connector device.
Figure 1B:
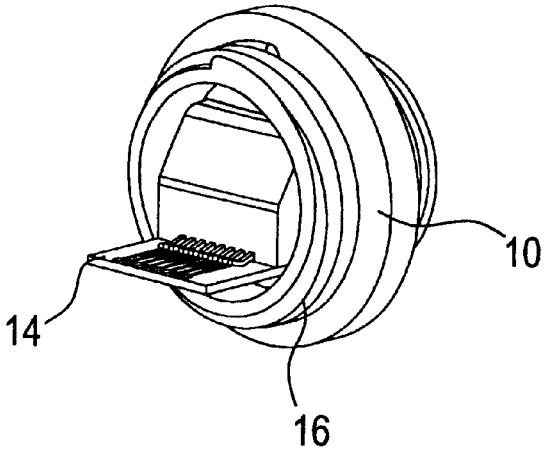
Figure 1C:
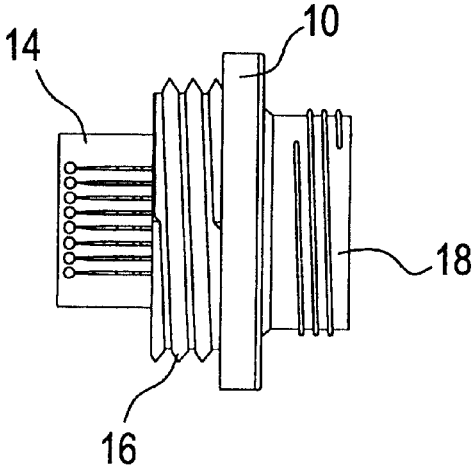
Figure 2A:
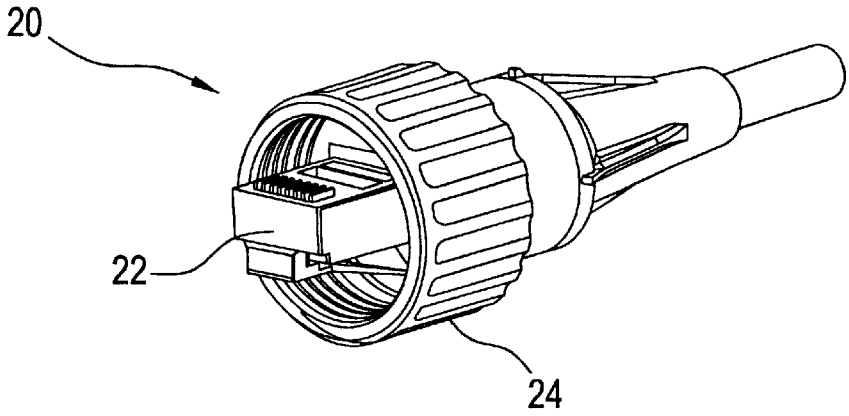
FIGS. 2A–2B are various views of a conventional telecommunications plug.
Figure 2B:
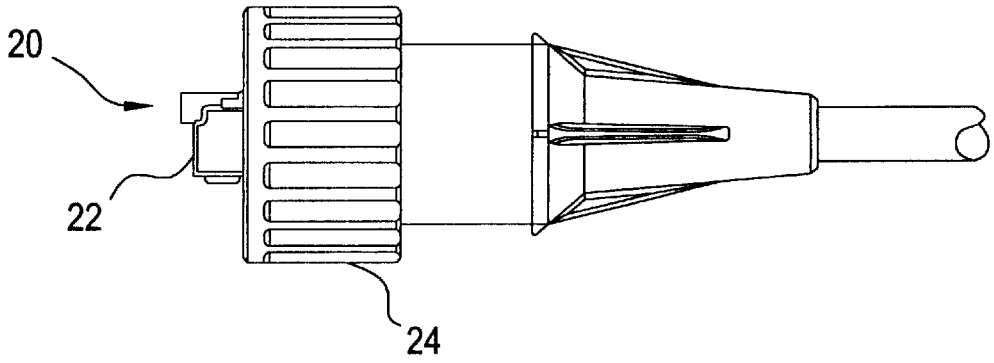
Figure 3:
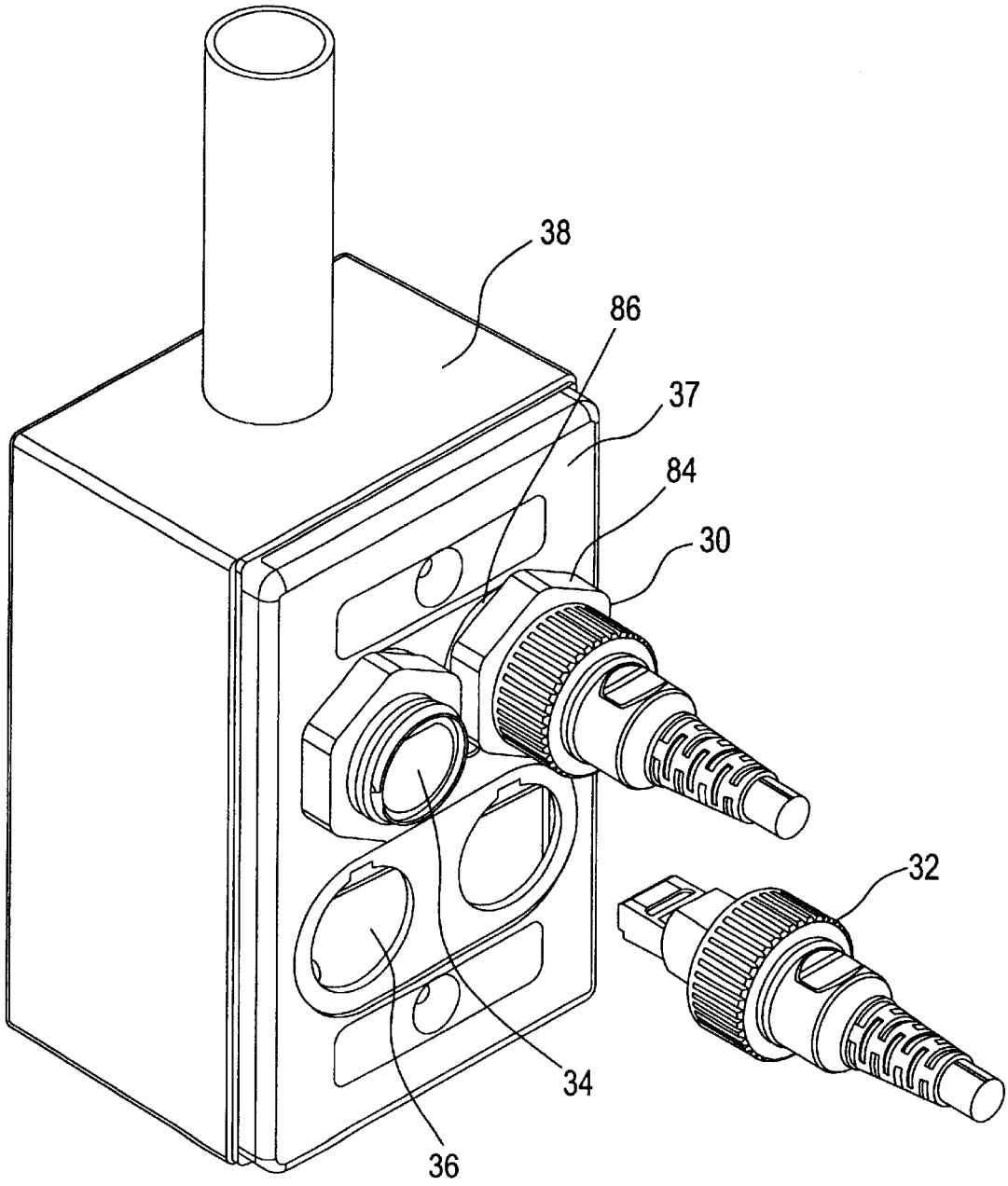
FIG. 3 is a perspective view of an industrial telecommunications connector and a connector housing according to the invention.
Figure 4B:
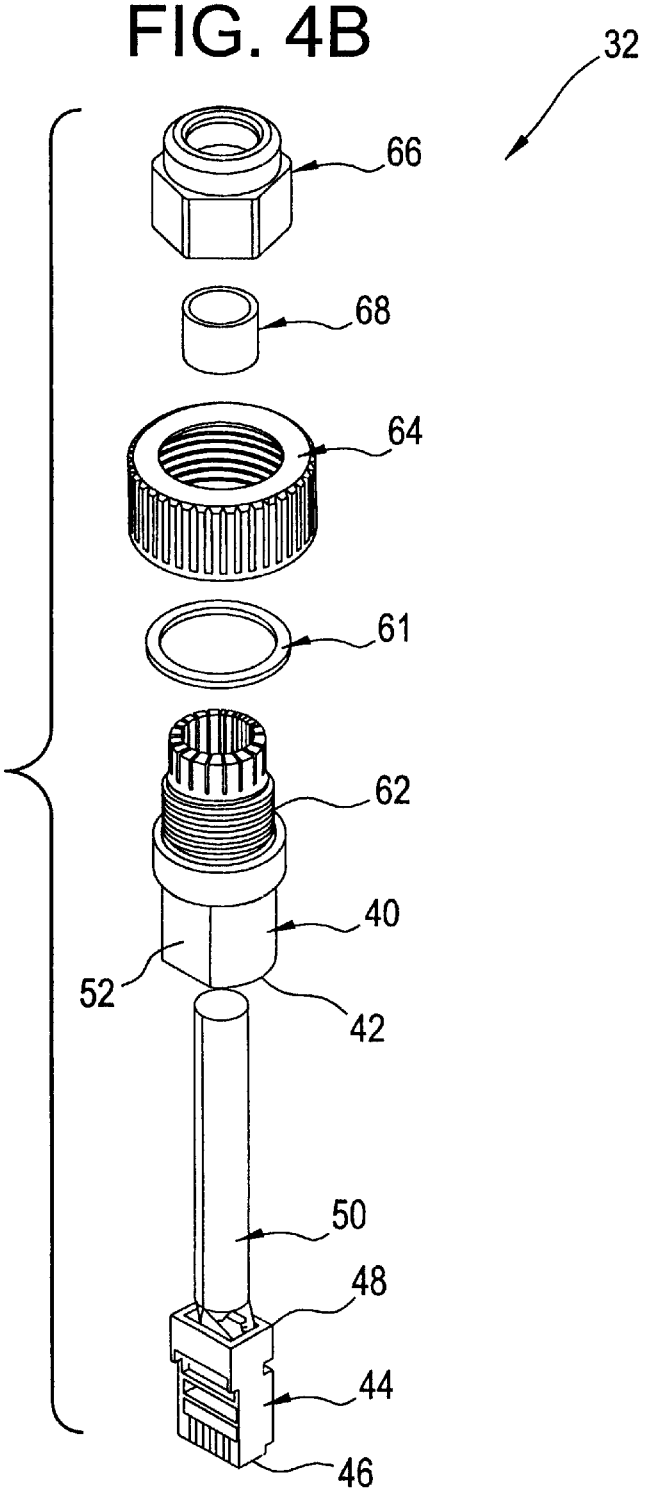
Figure 4A:
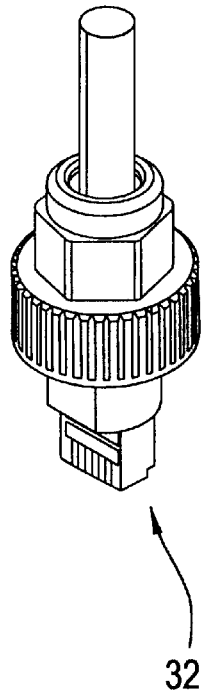
Figure 5A:
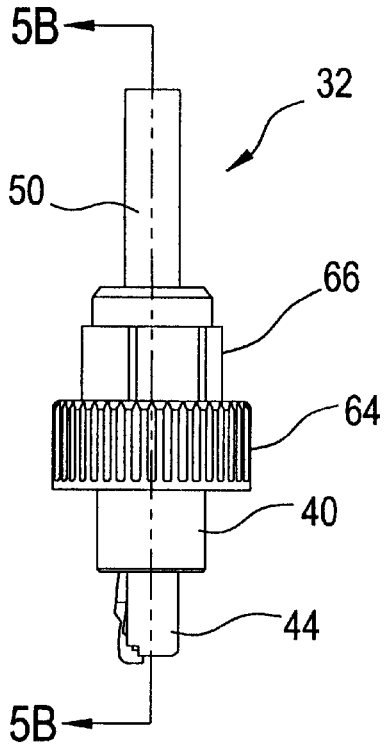
Figure 5B:
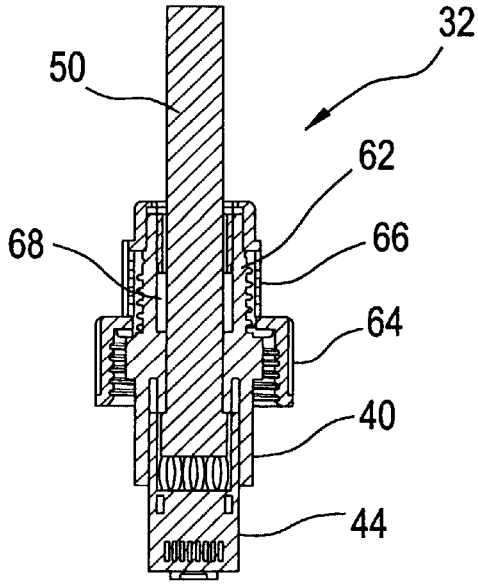
Figure 5C:
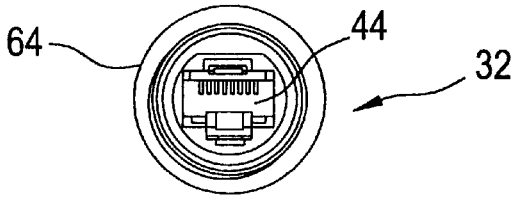
Figure 6:
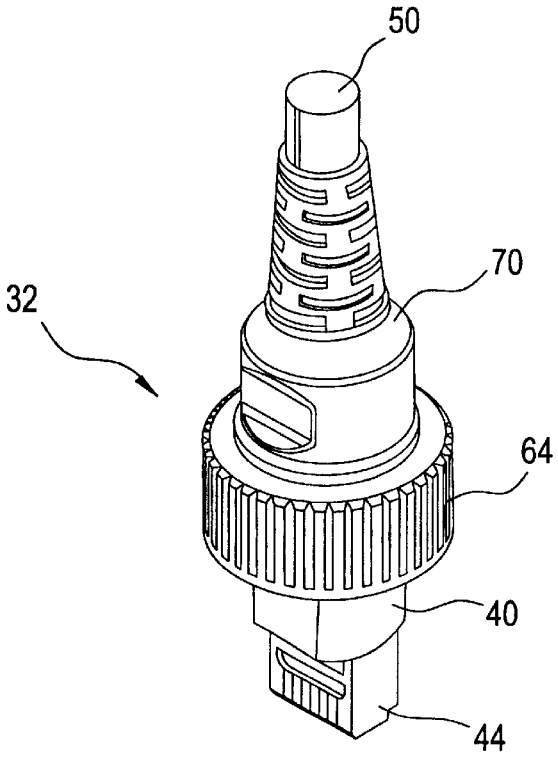
Figure 7:
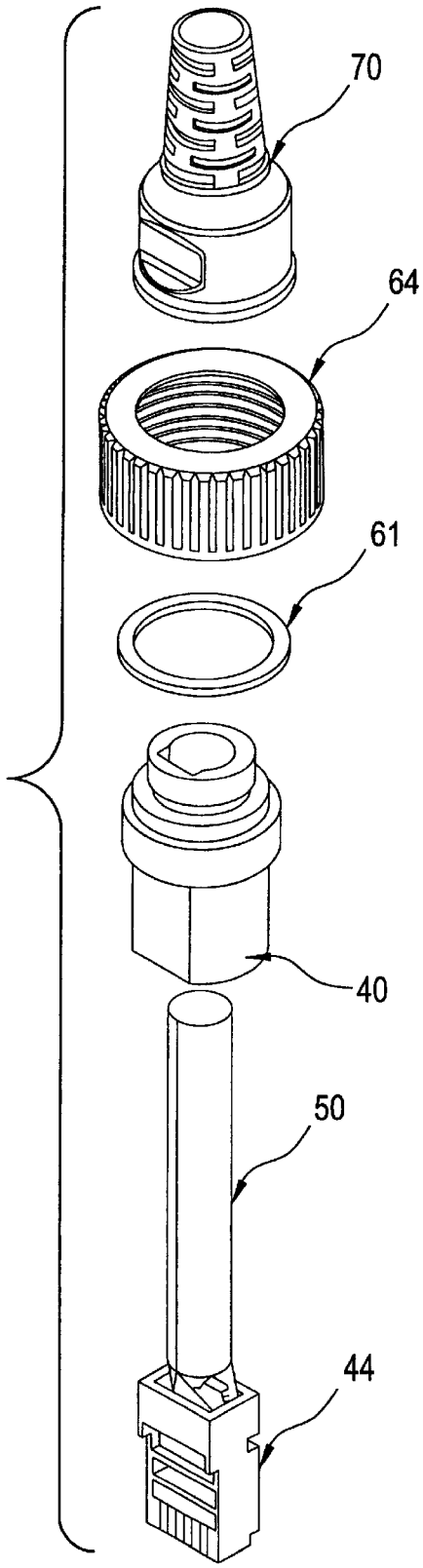

According an embodiment of the present invention, an industrial telecommunications connector 30 is disclosed as shown in FIG. 3. The industrial telecommunications connector 30 includes a plug assembly 32 and a jack assembly 34. The jack assembly 32 is located in a portal 36 of a connector housing 38 and receives the plug assembly 32.

FIGS. 4–9 show various embodiments of the plug assembly 32 in accordance with the present invention. Essentially, plug assembly 32 includes a modular plug receptacle 40 which, at a first end 42, receives a modular plug 44, preferably an RJ-45 modular plug.

The modular plug 44 generally has a contact end 46 which is positioned distal the modular plug receptacle 40 when the modular plug 44 is received in the receptacle 40. The modular plug 44 further includes a wired end 48 opposite the contact end 46, the wired end 48 is positioned within the receptacle 40. A cable 50 extends from the wired end 48 of the modular plug 44 and traverses through the plug assembly 32.

The modular plug receptacle 40 includes keying 52 such that the resulting plug assembly 32 mates only one way with the jack assembly 34.

The modular plug receptacle 40 is molded in a thermoplastic elastomer (TPE) material or similar compressible material of a durometer (about 85 shore A) that compresses slightly during connection with the jack assembly 34. This compression creates an IP67 sealed interface between the plug and jack assemblies.

When the plug assembly 32 is fully assembled, the modular plug receptacle 40 encapsulates the wired end 48 of the modular plug 44. The contact end 46 and approximately half of the modular plug 44 are left exposed at the first end 42 of the modular plug receptacle 40.

Figure 9:
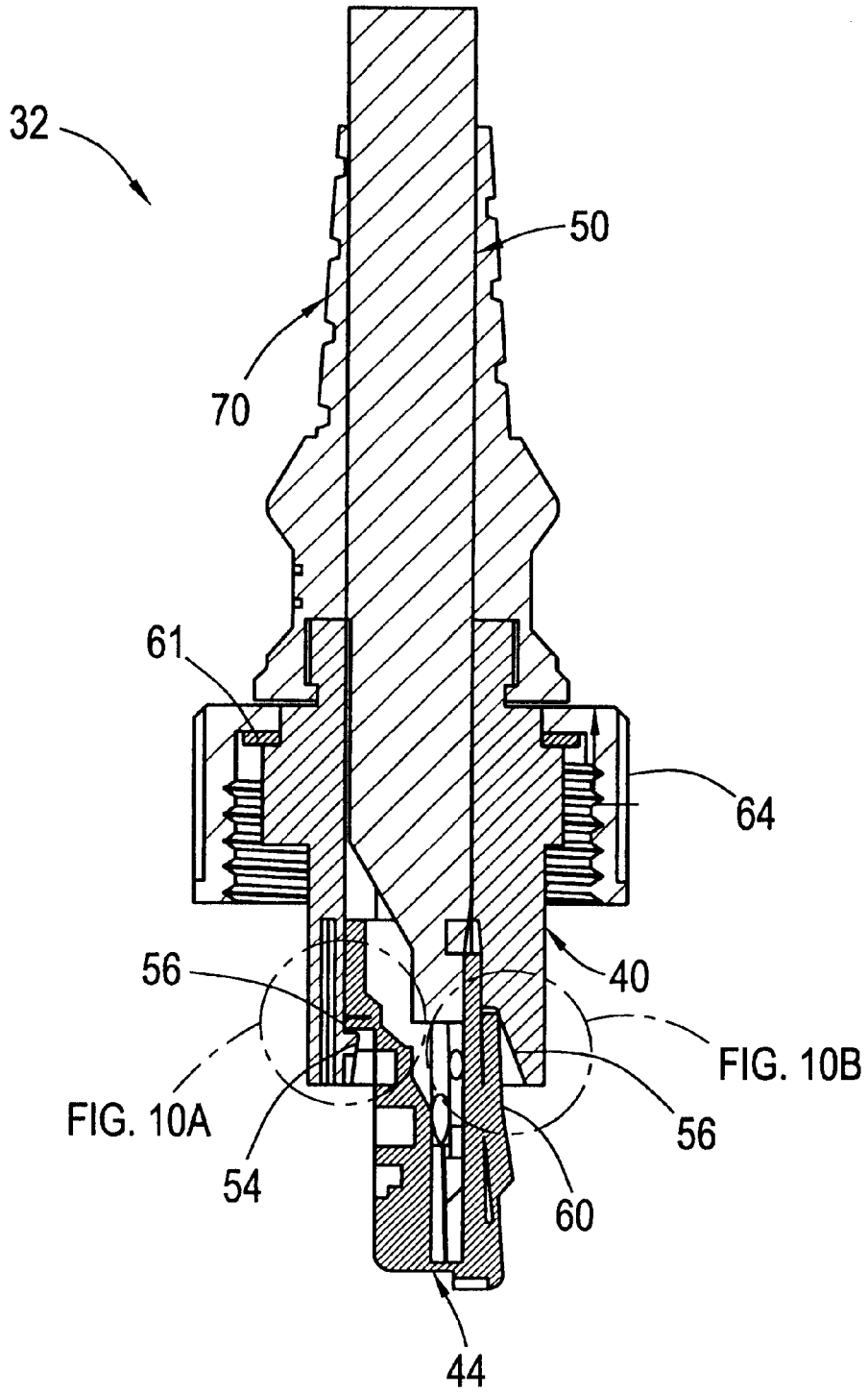
Figure 10A:
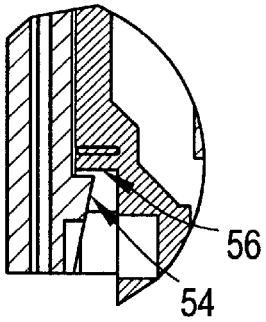
Figure 10B:
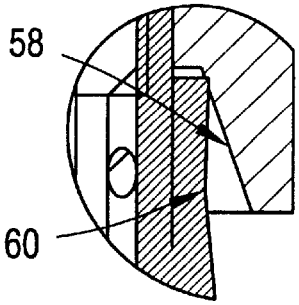
Figure 10C:
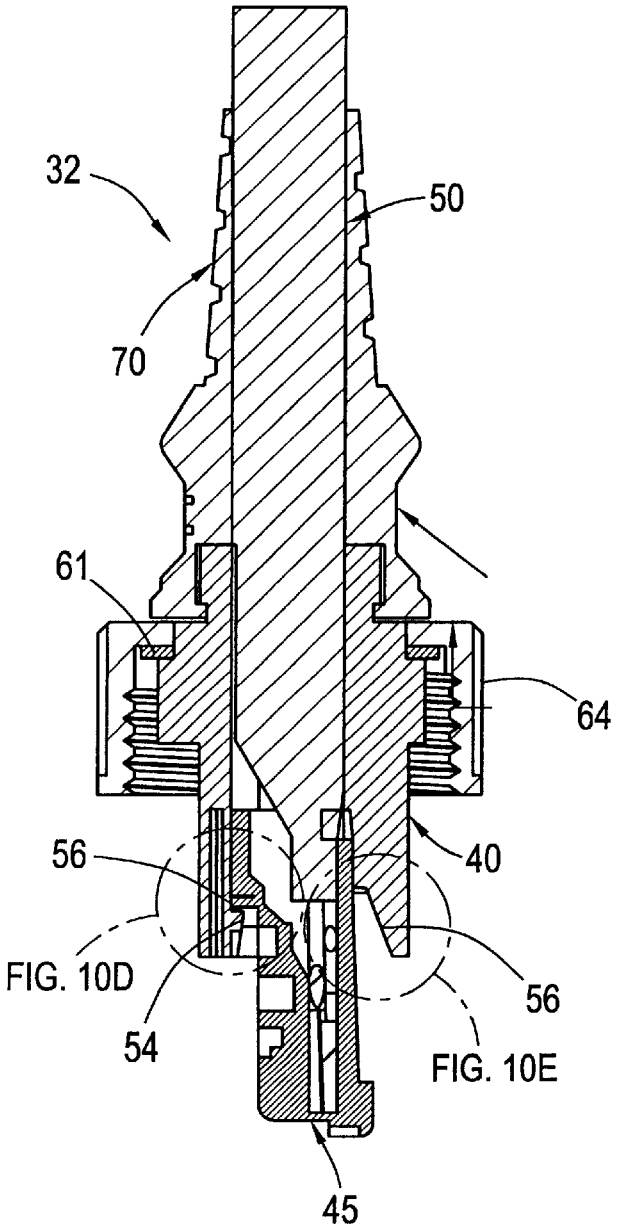
Figure 10D:
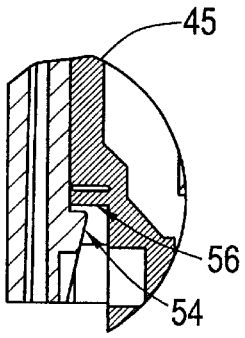
Figure 10E:
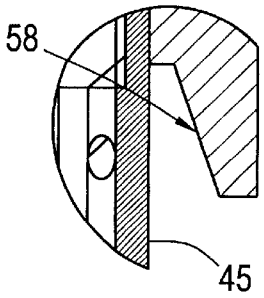
Figure 10F:
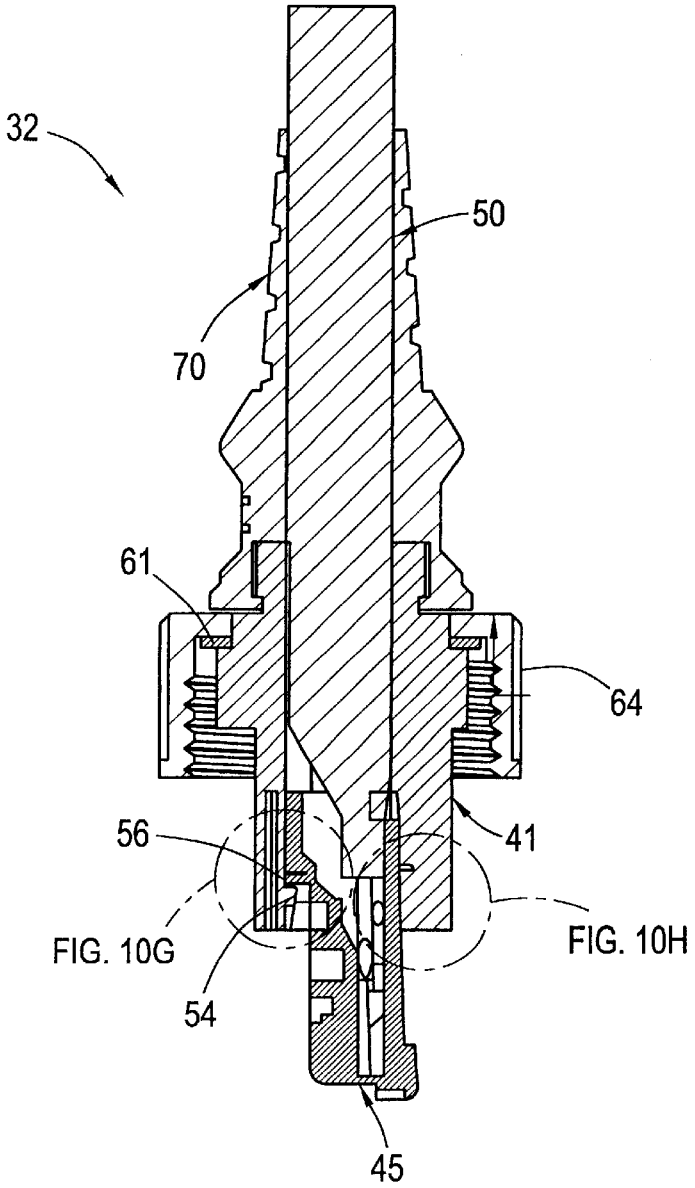
Figure 10H:
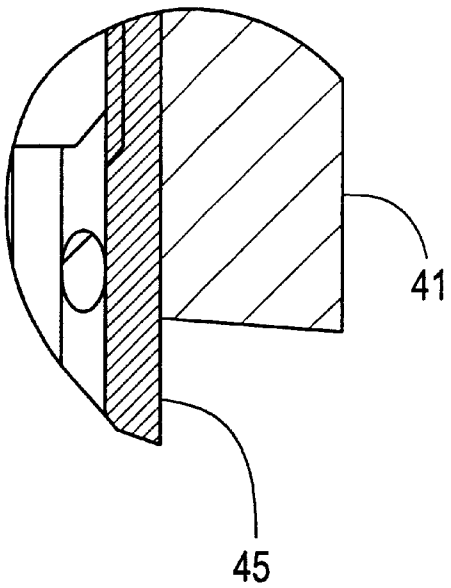
Figure 10G:
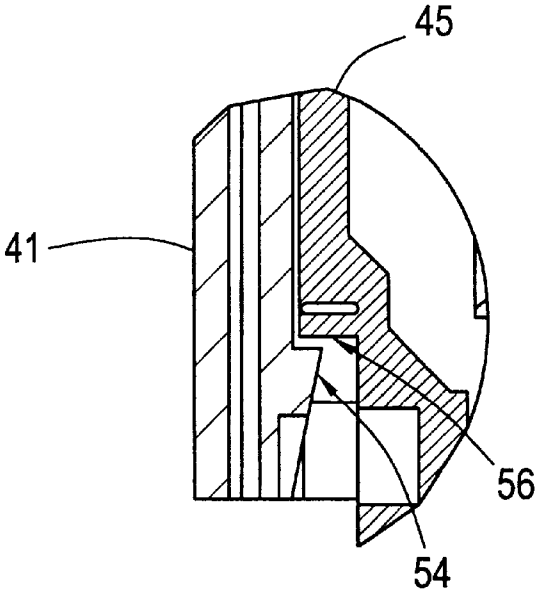
Figure 11A:
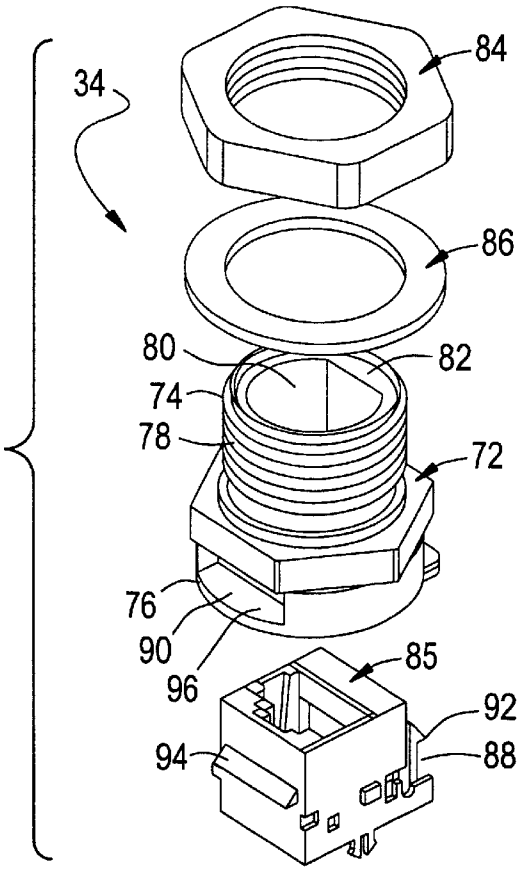
FIGS. 11A–11D are various views of a jack assembly of the industrial telecommunications connector of FIG. 3.
Figure 11B:
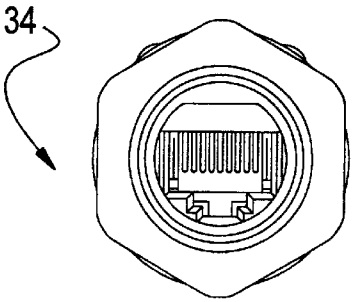
Figure 11C:
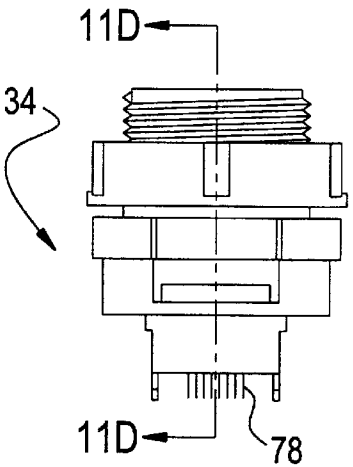
Figure 11D:
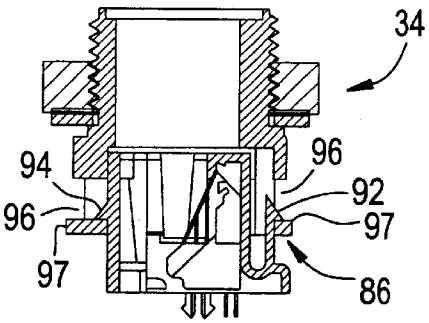
Figure 12A:
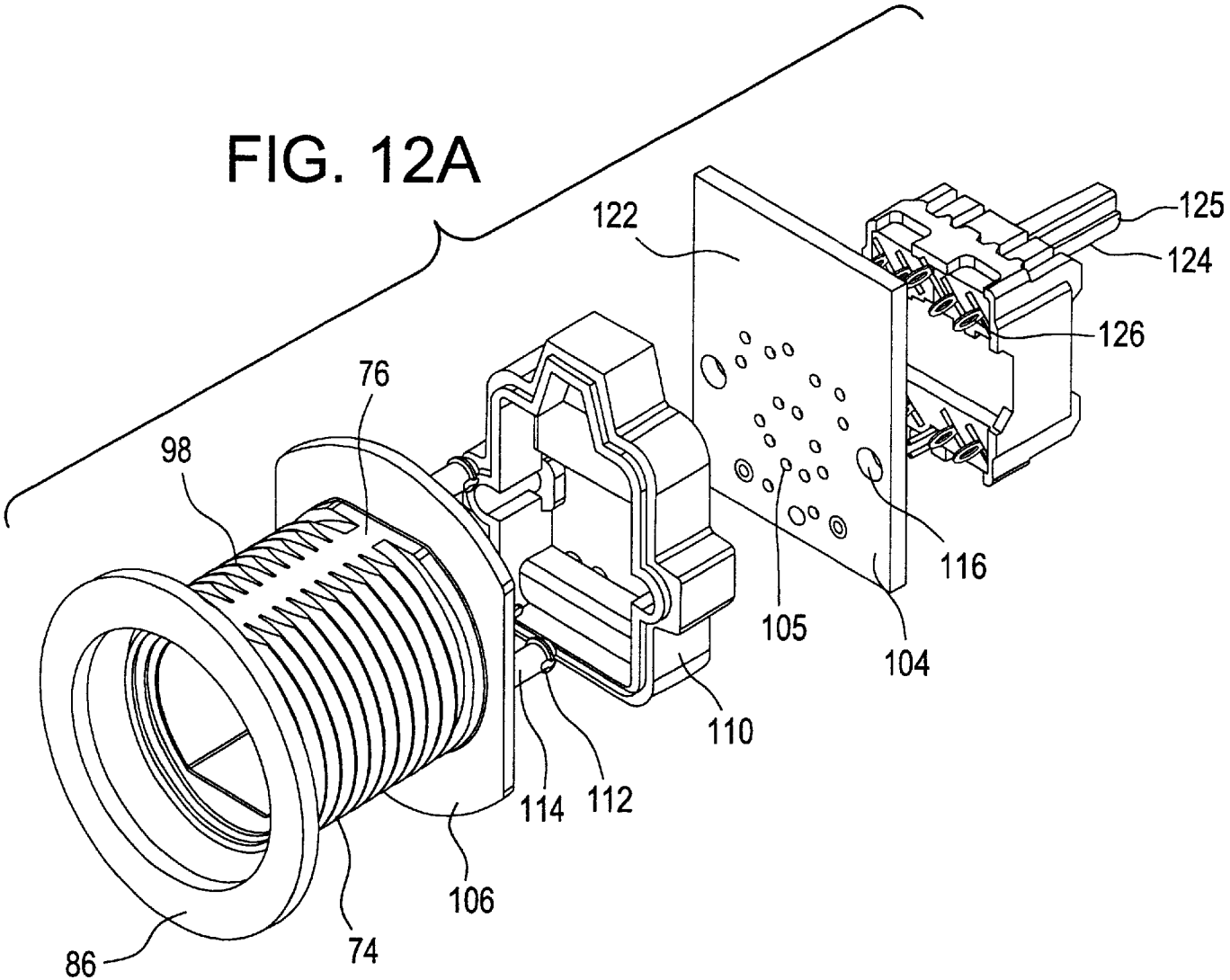
FIGS. 12A–12B are various views of another embodiment of the jack assembly of FIGS. 11A–11C.
Figure 12B:
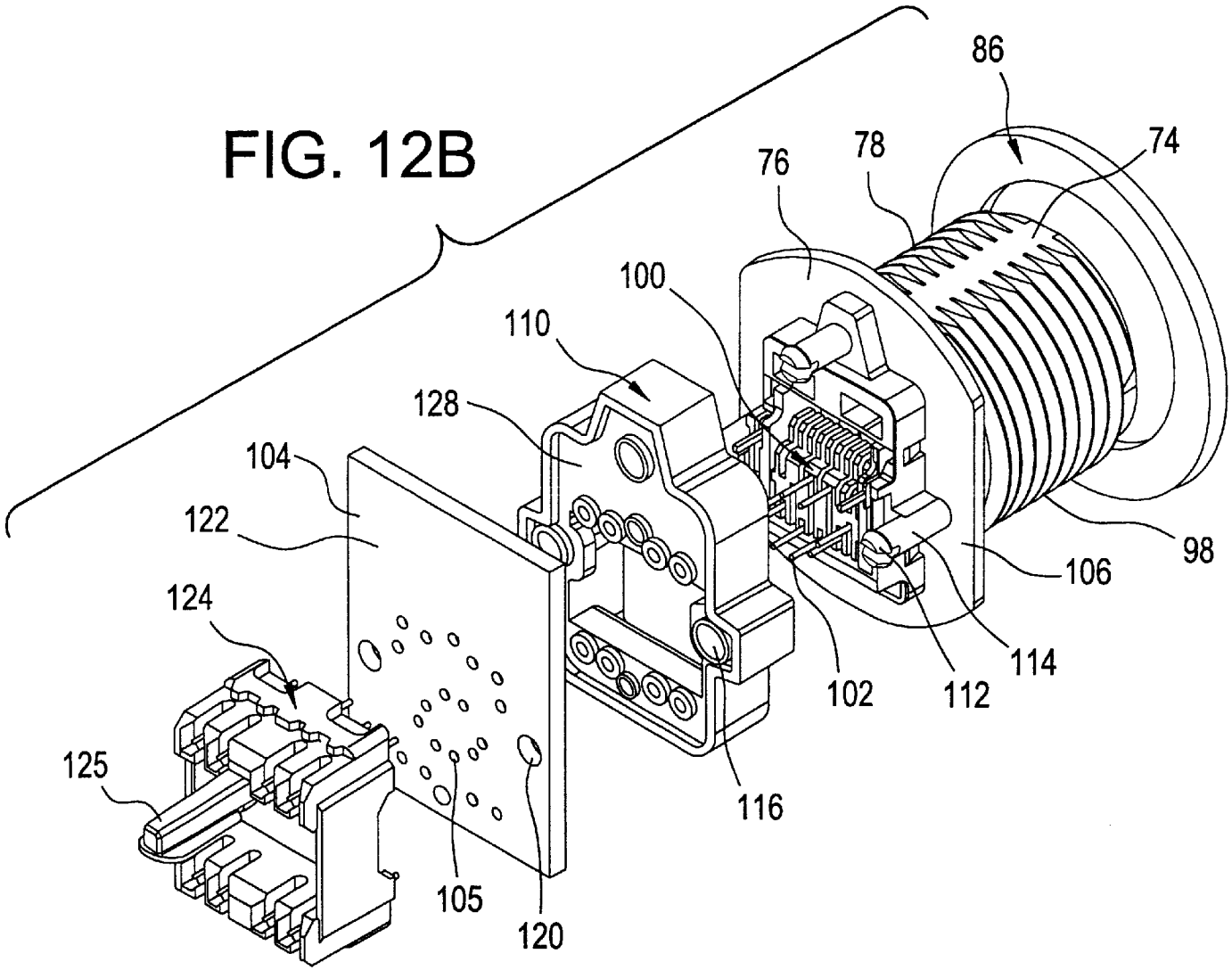
Figure 13B:
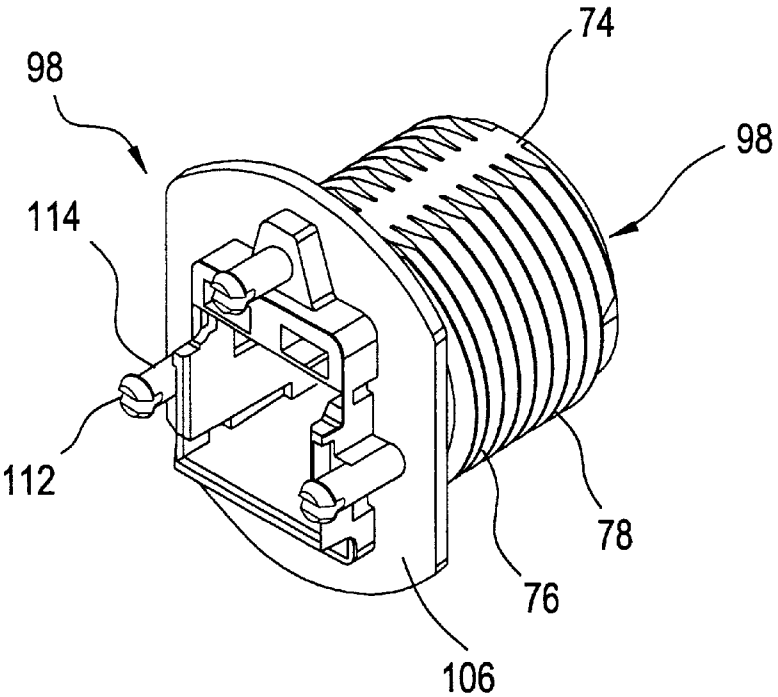
FIGS. 13–15 and 17 are various views of a modular jack housing.
Figure 13A:
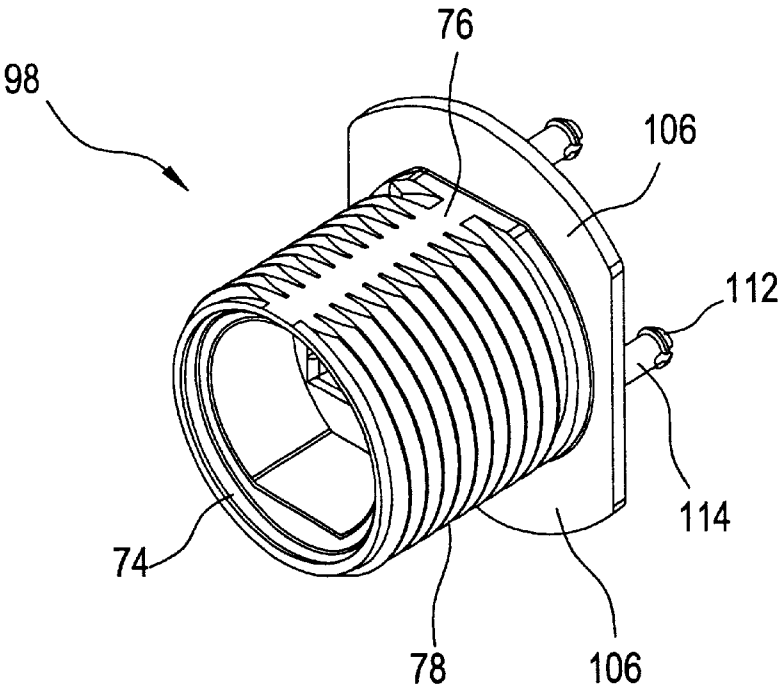
Figure 14A:
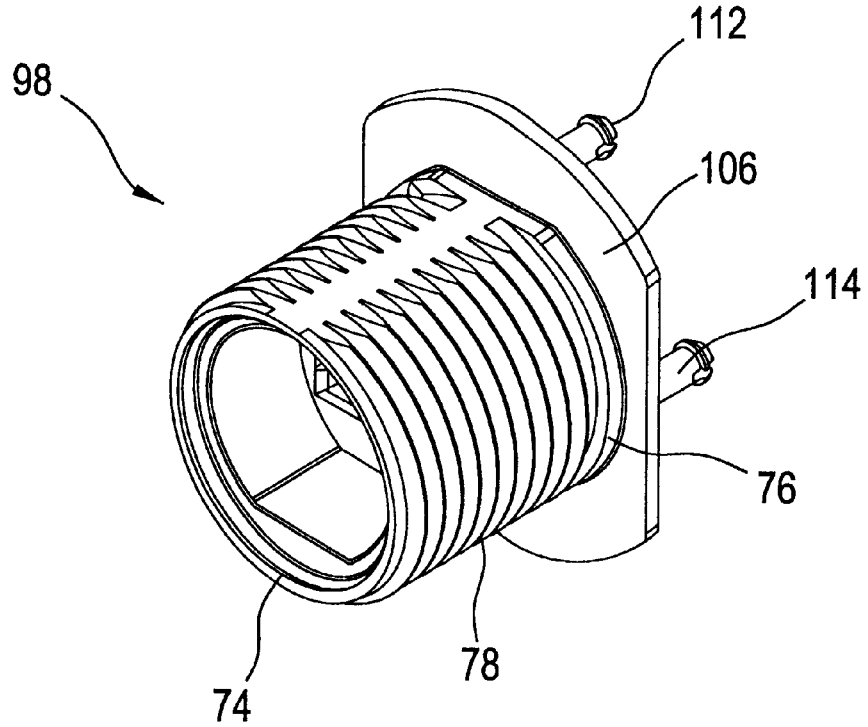
Figure 14B:
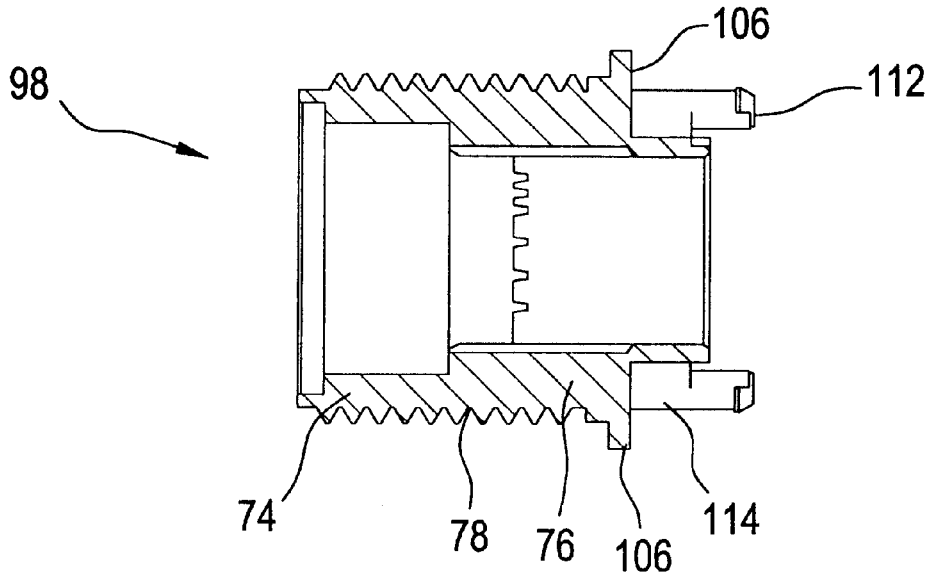
Figure 15B:
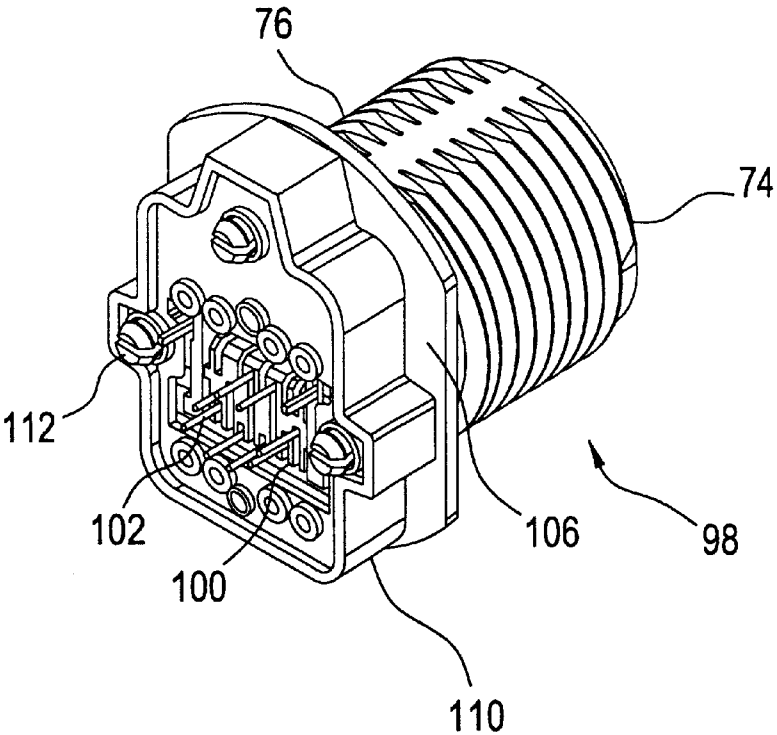
Figure 15A:
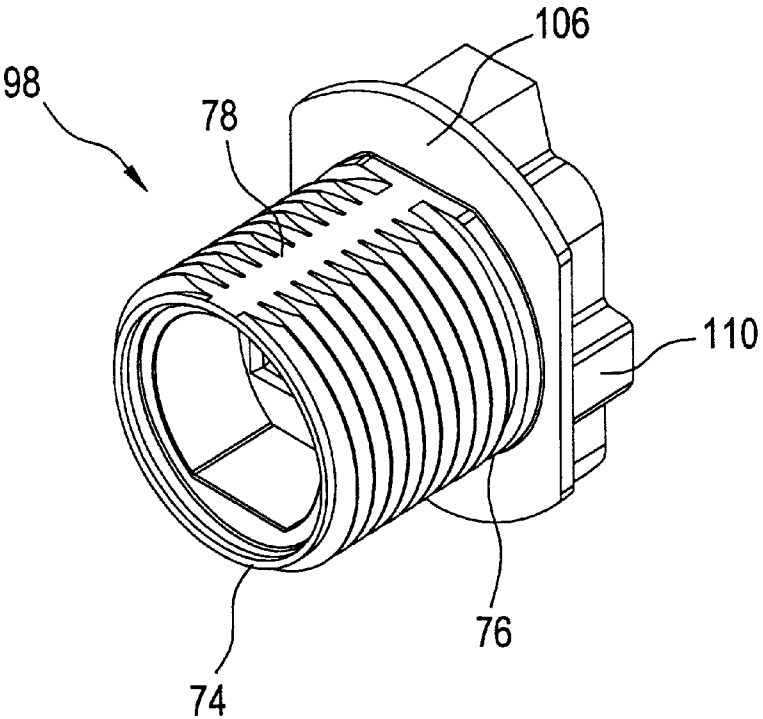
Figure 16:
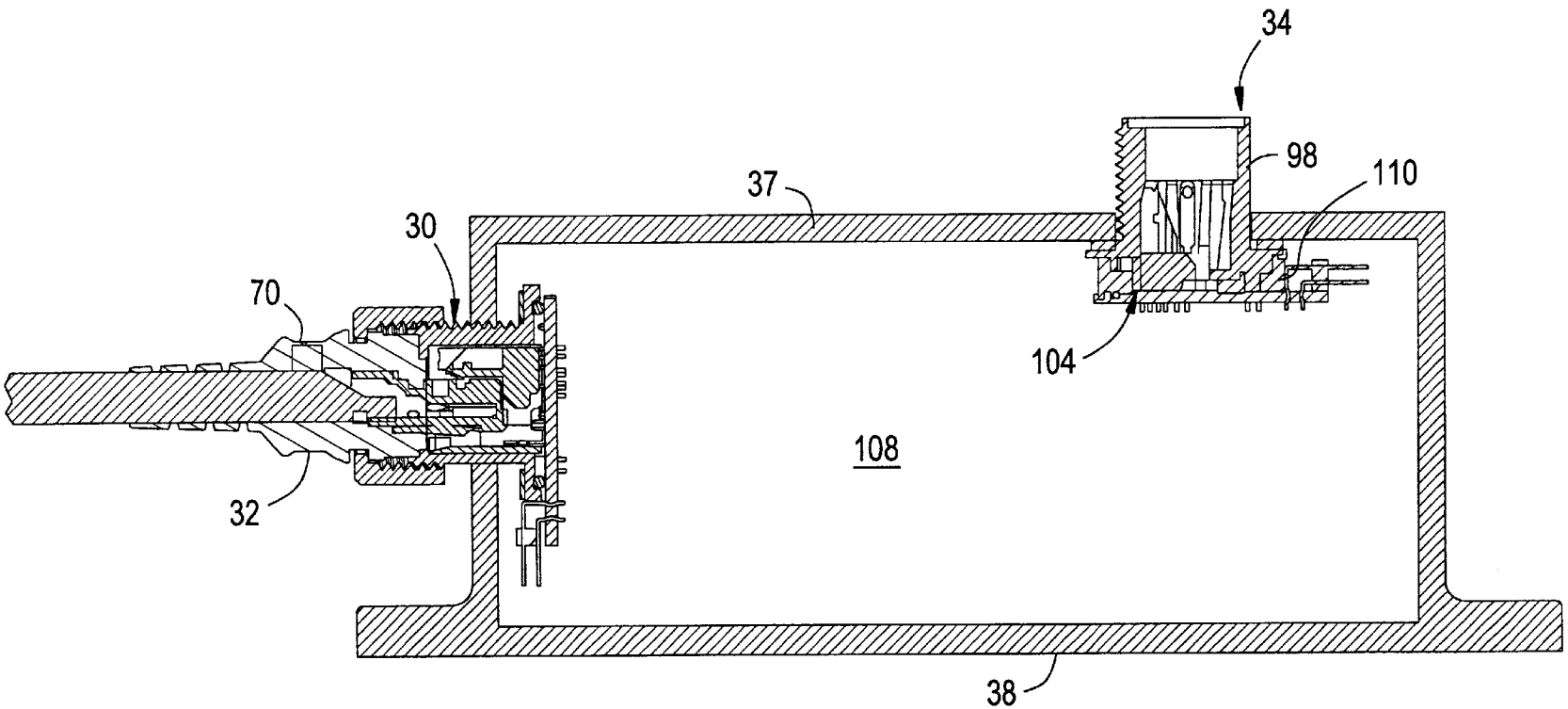
FIG. 16 is a cross-sectional view of the industrial telecommunications connector and the connector housing of FIG. 3.
Figure 17A:
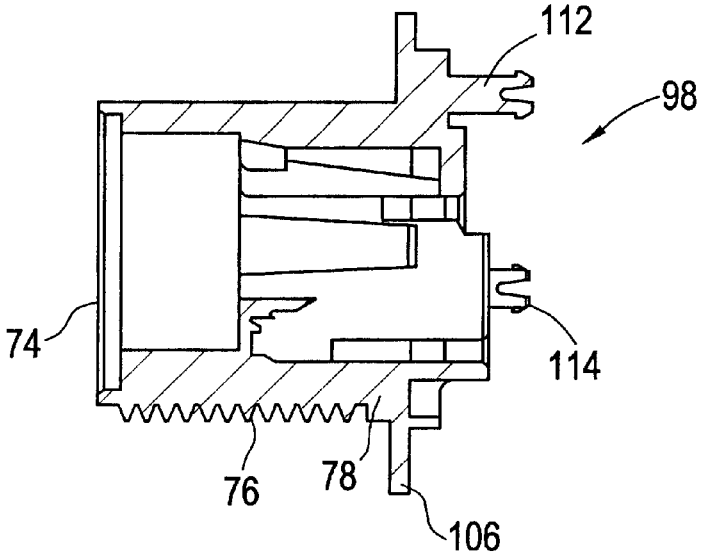
Figure 17B:
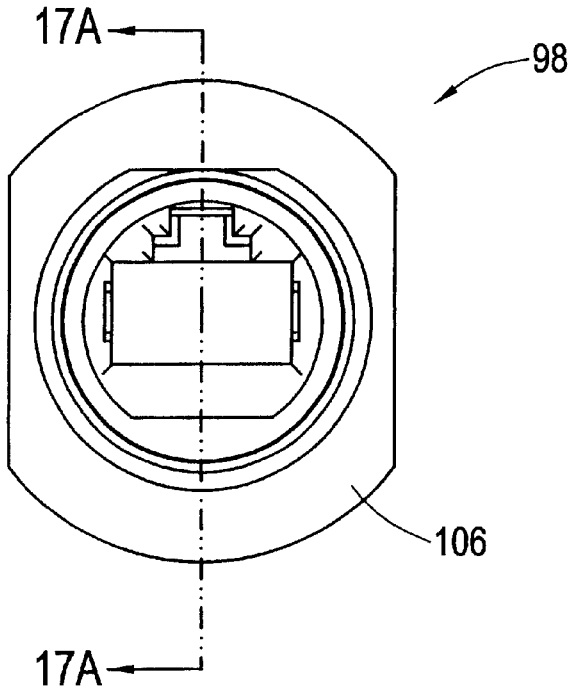
Figure 18:
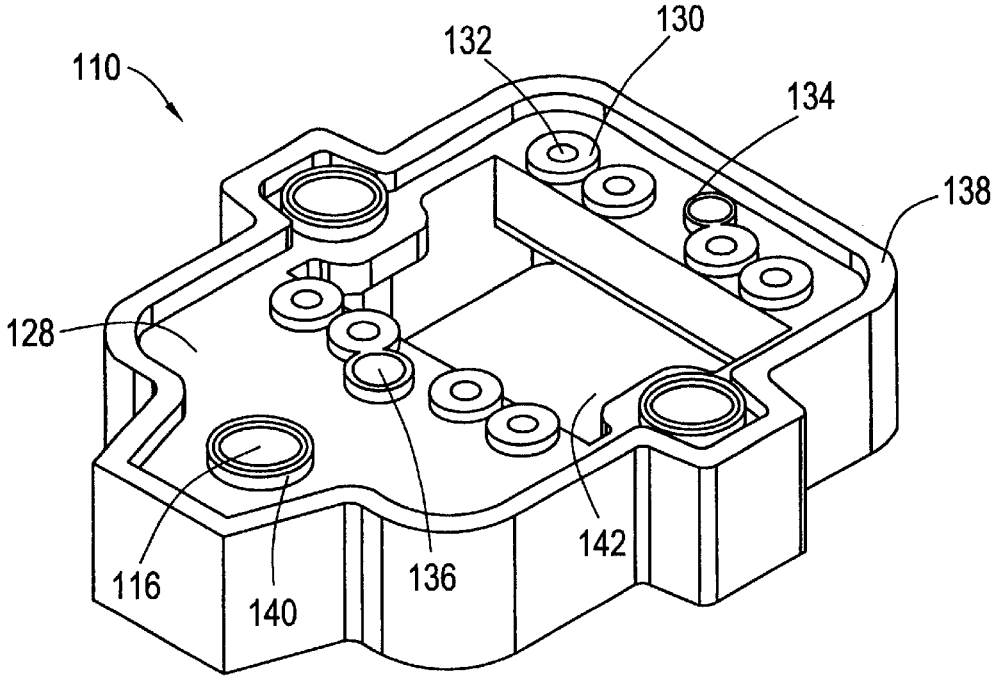
FIGS. 18–23 are various views of a sealing member.
Figure 19:
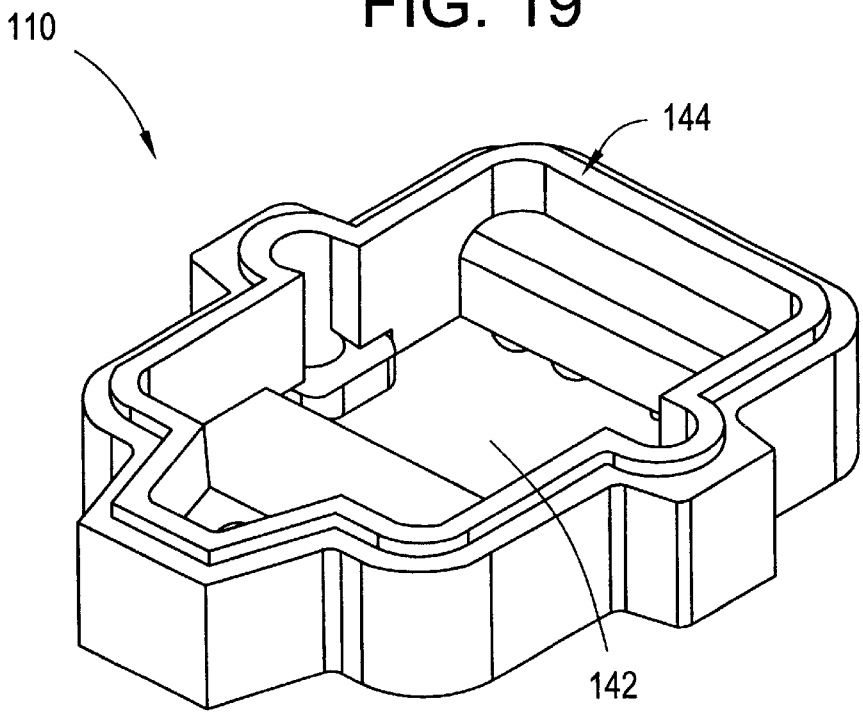
Figure 20:
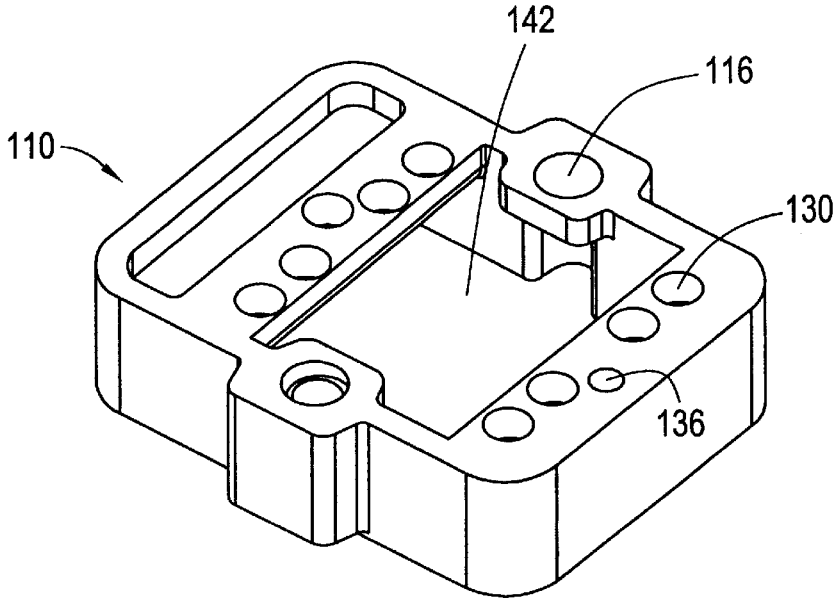
Figure 21:
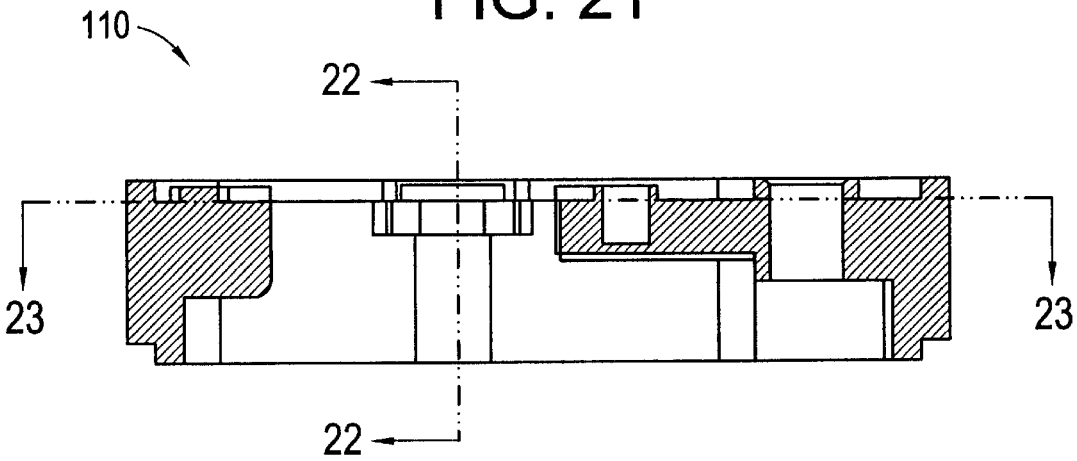
Figure 22:
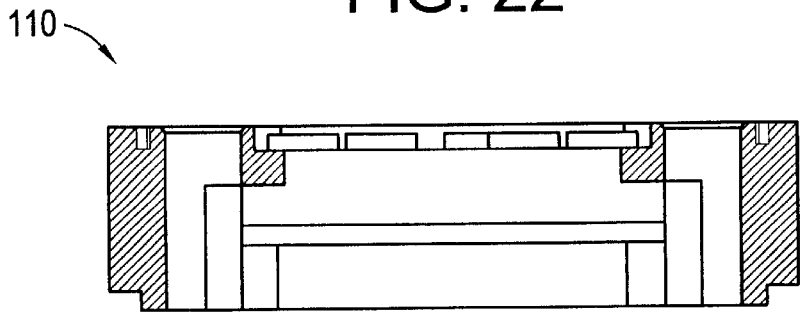
Figure 23:
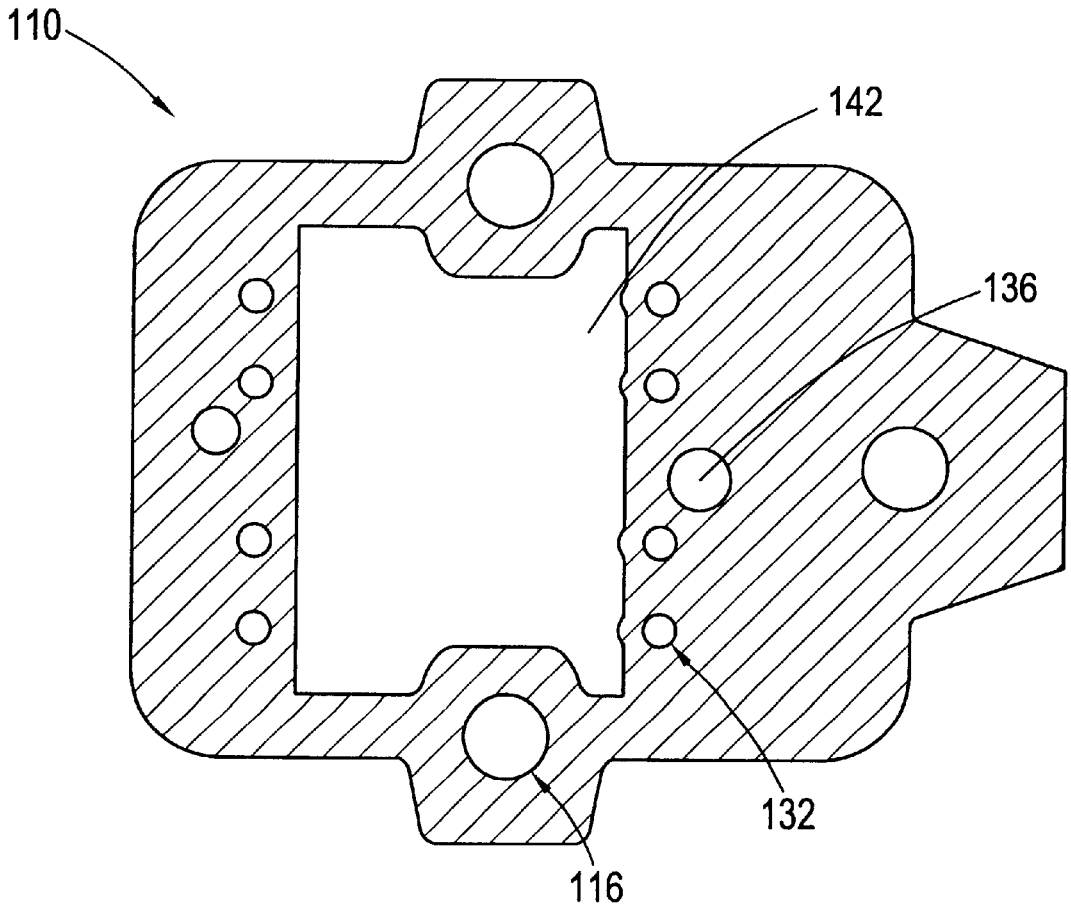
Figures 24, 25:
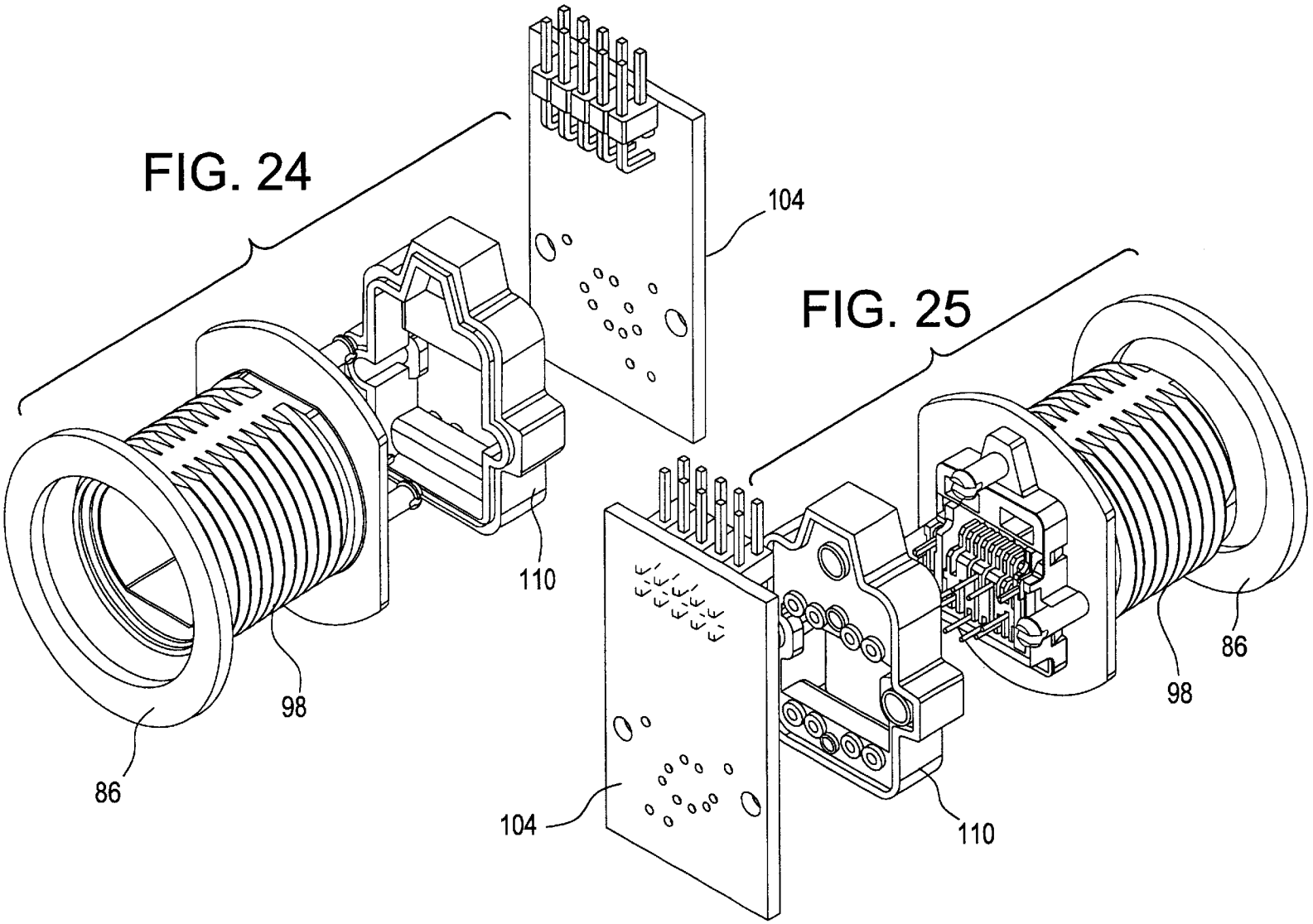
FIGS. 24 and 25 are various views of another embodiment of the jack assembly of FIGS. 11A–11C.
Figure 26:
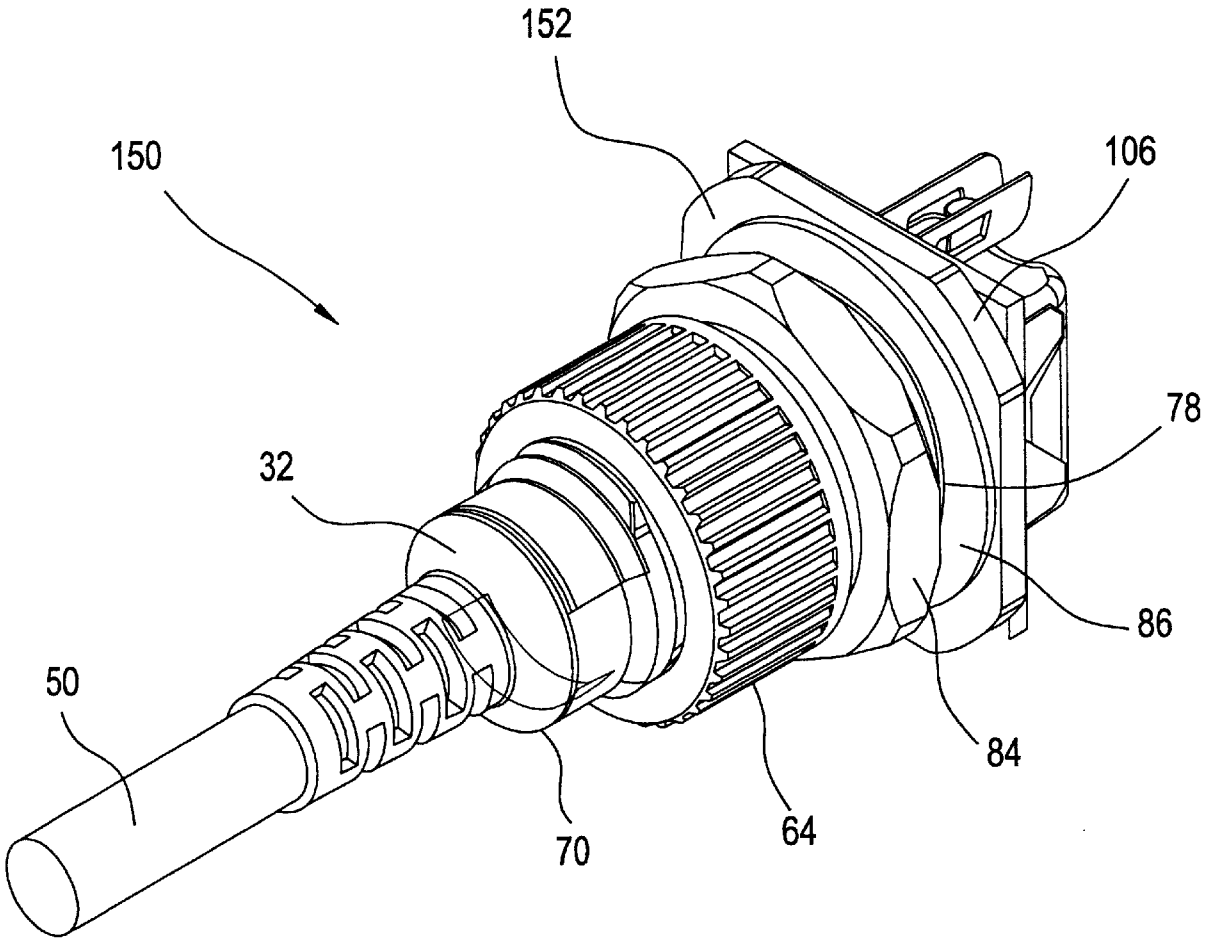
FIGS. 26–28 are various views of another embodiment of the industrial telecommunications connector of the invention.
Figure 27:
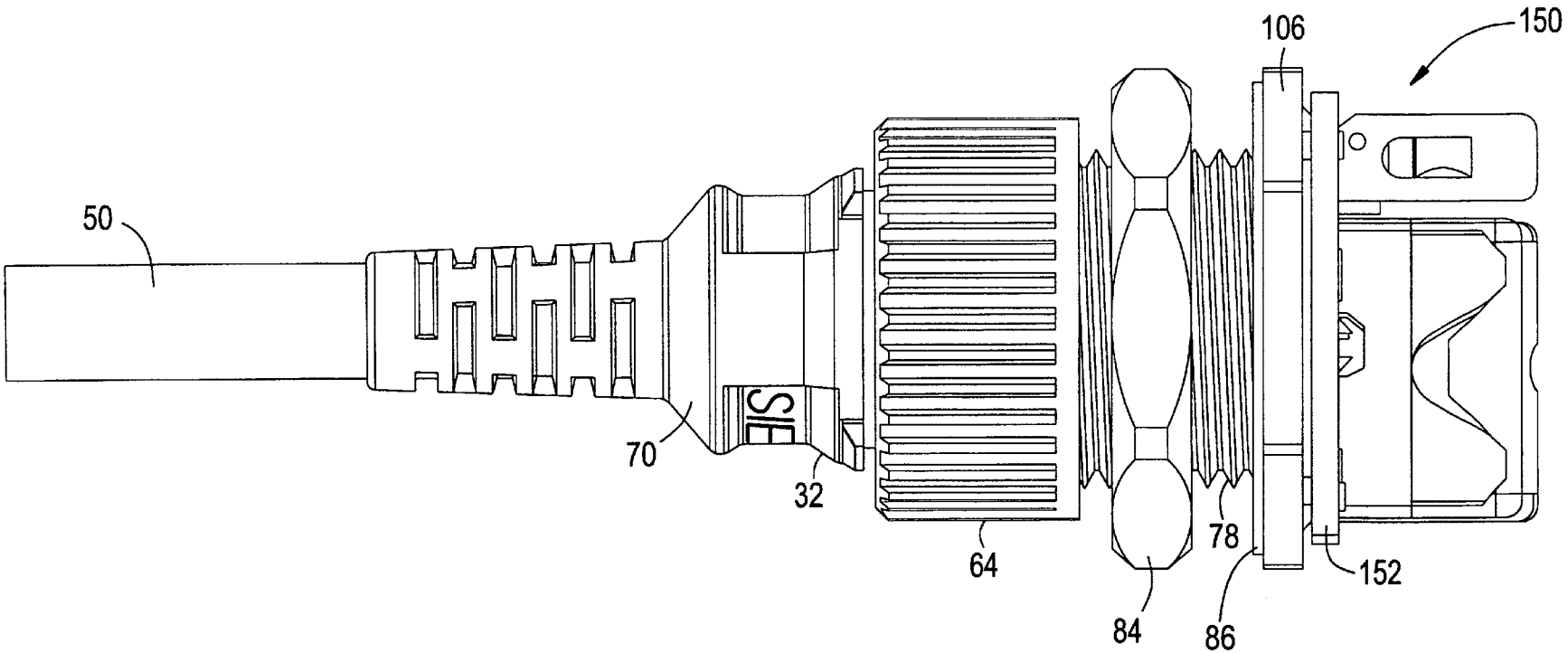

Referring now particularly to FIGS. 9–10, the modular plug receptacle 40 includes a modular plug retaining latch 54 which receives and retains an undercut 56 of the modular plug 44. The modular plug receptacle 40 further includes a latch defeat 58 for maintaining a latch 60 of the modular plug 44 in a depressed condition when fully recessed into the receptacle 40 such that the modular plug 44 may be readily mated with the jack assembly 34 without unnecessary toiling with the modular plug latch 60.

As shown in FIGS. 10C–10H, a modular plug 45 may be used that does not include the latch 60. The modular plug 45 may be used with the modular plug receptacle 40 which includes the latch defeat 58. Alternatively, the modular plug 45 may be used with a modular plug receptacle 41 that does not include the latch.

The modular plug receptacle further includes a nylon ring 61 located about the receptacle at a threaded end 62 for providing a seal between the modular plug receptacle 40 and a threaded shoulder nut 64 and the jack assembly 34 when the plug assembly 32 is mated with the jack assembly 34 as described herein. The threaded shoulder nut 64 is located on the modular plug receptacle 40 such that it floats, i.e. maintains rotational maneuverability about a longitudinal axis of the plug assembly 32.

A compression nut 66 and a compression gasket 68 are used to fasten the modular plug receptacle 40 and threaded shoulder nut 64 together as well to secure the cable 50 which passes there through. The threaded end 62 of the modular plug receptacle 40 receives the compression nut 66, the compression gasket 68 is located about the cable 50. The cable 50 exiting from the modular plug receptacle 40 is sealed at the threaded end 62 by the compression gasket 68 and the compression nut 66. Tightening of the compression nut 66 creates a seal around a jacket of the cable 50 allowing accommodation of different cable diameters. In addition, the compression nut 66 retains the threaded shoulder nut 64 which is necessary for mating and compressing the seal between the plug and jack assemblies.

An alternative method of sealing the cable at the threaded end 62 of the modular plug receptacle 40 is achieved by over molding a strain relief housing 70 around the modular plug receptacle 40 as shown in FIGS. 6–10. The over molded strain relief housing 70 also retains the threaded shoulder nut 64 in addition to sealing the cable interface. The threaded shoulder nut 64, which "floats", on the plug assembly 32 threads onto the jack assembly 32 and when tightened forms a seal under compression, the sealing surface of which is perpendicular to the axis of plug and jack assemblies 32, 34.

The jack assembly 34, shown in one embodiment in FIGS. 11A–D, includes a modular jack housing 72 which, at a front end 74 receives the plug assembly 32 and at a rear end 76 includes connecting contacts for mating with connection equipment (not shown) within the connector housing 38 (FIG. 3).

The front end 74 of the modular jack housing 72 includes a threaded portion 78 to facilitate reception of the plug assembly 32. The threaded portion 78 of the front end is keyed to facilitate convenient and consistent mating with the threaded shoulder nut 64 of the plug assembly 32. Further, a receiving opening 80 of the front end 74 of the modular jack housing 72 includes keying 82 to facilitate reception of the modular plug 44 of the plug assembly 32.

Referring now to FIGS. 11A–11D and 3, the modular jack housing 72 is positioned from behind and fitted into the keyed or non-keyed portal 36 of the connector housing 38. The jack housing 72 is molded in a nylon thermoplastic material for superior chemical resistance. The jack housing 72 is secured from a faceplate 37 of the housing 38 using a locknut 84; a sealing member 86 seals the portal 36 from within the housing 38 at faceplate 37. The sealing member 86 and the locknut 84 create a fluid-tight seal between the modular jack housing 72 and the faceplate 37 of the connector housing 38.

In the embodiment of FIGS. 11A–11D, a modular jack 85 is received in the rear end 76 of the modular jack housing 72 and retained therein by a latching system 86. The latching system 86 includes a latching means 88 disposed on the modular jack 85 and a reception means 90 formed in the rear end 76 of the modular jack housing 72. The latching means 88 includes a first latch 92 formed on a side of the modular jack 85 and a second latch 94 formed on a side of the modular jack 85 opposite the first latch 90. The reception means 90 includes receptive cavities 96 having latch walls 97. The latching means 88 is selectively received and retained within the reception means 90 by the first and second latches 92, 94 entering corresponding receptive cavities 96 and fixing on latch walls 97.

The latching system 86 allows easy assembly and disassembly of the modular jack 85 and the modular jack housing 72. In this way, the industrial telecommunications connector 30 may be rapidly assembled to establish a viable telecommunication connection as desired and also easily and readily disassembled for maintenance and/or replacement.

A second embodiment of the modular jack housing is shown in FIGS. 12–24, indicated generally by reference numeral 98. Similar elements of various embodiments of the invention are indicated by similar reference numerals throughout.

The rear end 76 of the modular jack housing 98 includes a contact holder 100 which is slotted and contains pins 102 that make contact with the modular plug 44 when the plug assembly 32 is mated from the front end 74 of the housing 98. The pins 102 are soldered to a printed circuit board (PCB) 104 which is attached to the rear end 76 of the modular jack housing 98. The PCB 104 includes various openings 105 formed therein to allow passage of connection elements such as, for example, the pins 102.

A sealing surface 106 is formed between the contact holder 100 and the threaded portion 78 of the modular jack housing 98. The sealing surface 106, utilizing an elastomer seal 86, forms a seal between the modular jack housing 98 and the connector housing 38 which prevents the passage of fluids or other debris which may impair connector functioning.

Referring now to the several Figures, with particular emphasis on FIGS. 3 and 12–17, a potting compound 108, such as silicon gel, is used to encapsulate a portion of the modular jack housing 98 when mounted in the connector housing 38. To prevent the potting compound 108 from leaking through the modular jack housing 98, interfering with the pins 102, and disturbing the electrical connection, a sealing member 110 is disposed between the contact holder 100 and the PCB 104. The sealing member 110 eliminates all leakage paths into the contact holder 100 and completes back sealing requirements for the IP67 RJ45 modular jack housing 98.

The sealing member 110 is made from a TPE or similar compressible material. The sealing member 110 is compressed when fully assembled between the modular jack housing 98 and PCB 104. The compression is the result of the sealing member 110 having a slightly oversized thickness and then being subjected to pressure between the modular jack housing 98 and the PCB 104. That is, the sealing member 110 is of a slightly larger thickness than the distance of the desired disposition of the PCB 104 relative to the sealing surface 106. Then, the sealing member 110 is placed between the sealing surface 106 and the PCB 104 and compressed to achieve the desired disposition and distance.

The compression of the sealing member 110 is maintained by post latches 112 that retain the PCB 104 in a specified position. The post latches 112 are located on posts 114 which extend from the rear end 76 of the modular jack housing 98. The posts 114 extend through holes 116 formed in the sealing member 110 and through holes 120 formed in the PCB 104. The post latches 112 fasten on a distal side 122 of the PCB 104 opposite the modular jack housing 98. The post latches 112 hold the PCB 104 and the sealing member 110 to the rear end 76 of the modular jack housing 98.

The pins 102 extend from the contact holder 100 through the sealing member 110 and the PCB 104. The pins 102 are soldered or press fit to the PCB 104, for example, on the distal side 122.

A connecting block 124 is attached to the distal side 122 of the PCB 104 to provide for electrical connection with the pins 102. The connecting block 124 includes insulation displacement contacts 126 in electrical connection with the pins 102 through which extend through the PCB 104. The connecting block also includes a grounding pin 125.

Referring now with particular emphasis to FIGS. 18–23, the sealing member 110, on a first side 128, includes a plurality of first raised features 130 disposed about openings 132. The openings 132 are formed in the sealing member 110 for receiving and allowing passage through the sealing member 110 of the insulation displacement contacts 126. The first raised features 130 are compressible and press against the PCB 104 to seal the insulation displacement contacts 126 as they pass through the PCB 104 and the sealing member 110 to establish connectivity with the modular jack 85. Preferably, the sealing member 110 includes eight first raised features 130.

The sealing member 110 also includes, on the first side 128, a plurality of second raised features 134 disposed about openings 136. The openings 136 are formed in the sealing member 134 for receiving and allowing passage through the sealing member 110 of connectivity elements including, for example, the ground lead 125 and location pins (not shown). The second raised features 134 are compressible and press against the PCB 104 to seal the connectivity elements. Preferably, the sealing member 110 includes two second raised features.

The sealing member 110 also includes, on the first side 128, a flange 138. The flange 138 extends from the sealing member 110 and around a periphery thereof. The flange 138 is compressible and forms a seal against the PCB 104 when the sealing member 110 is disposed there against. The seal created by the flange 138 prevents passage of the potting compound 108, dirt, dust, debris, and other non-desirable elements and/or substances.

The sealing member 110 also includes, on the first side 134, post hole raised features 140 disposed about post holes 116. As with the first and second raised features discussed herein above, the post hole raised features 140 are compressible and serve to seal the posts 114 and post holes 116 against the PCB 104.

The first raised features 130, the second raised features 134, the flange 138, and the post hole raised features 140, in one embodiment, are made of the same compressible material and compress to a desired level at which the various seals desired, discussed above, are attained. Of course, the various raised features mentioned herein may be composed of different materials and may be designed to compress to different levels.

The sealing member 110 additionally includes a contact passageway 142 extending from the first side 128 to a second side 144 located opposite the first side 128. The contact passageway 142 receives and allows the contact holder 100 and pins 102 to pass through the sealing member 110 and thus to engage the PCB 104 and the connecting block 124.

The first raised features 130 and the second raised features 134 are disposed about the contact passageway 142, preferably, four first raised features 130 and one second raised feature 134 are disposed on a first side of the contact passageway 142 and another four first raised features 130 and one second raised feature 134 are disposed on a second side of the contact passageway 142 where the first and second sides are opposite one another.

The sealing member 110 also includes, on the second side 144, a second flange 146 of a compressible material extending from the member 110 and traversing the periphery thereof. The second flange 146 creates a seal against the modular jack housing 98 and, particularly, against the sealing surface 106.

FIGS. 26–30 show another embodiment of the industrial telecommunications connector of the present invention, generally indicated by reference number 150. Here again, similar elements of various embodiments of the invention are indicated by similar reference numerals.

The industrial telecommunications connector 150 includes the plug assembly 32 and a jack assembly 152. The jack assembly 152 includes the modular jack housing 98 which receives the modular jack 85. The modular jack housing 98 includes the sealing surface 106 at the rear end 76. The jack assembly 152 includes the PCB 104 and the connecting block 124.

The jack assembly 152 also includes an O-ring 154 disposed between the PCB board 104 and the sealing surface 106. The O-ring 154 is made of a compressive material and forms a seal between the PCB board 104 and the sealing surface 106. This seal is achieved by utilizing a slightly over-sized O-ring 154 and then compressing the O-ring by adjoining the sealing surface 106 to the PCB 104, about the O-ring 154, with the posts 114. The O-ring 154 prevents undesirable substances from entering the connector 150.

Figure 28:
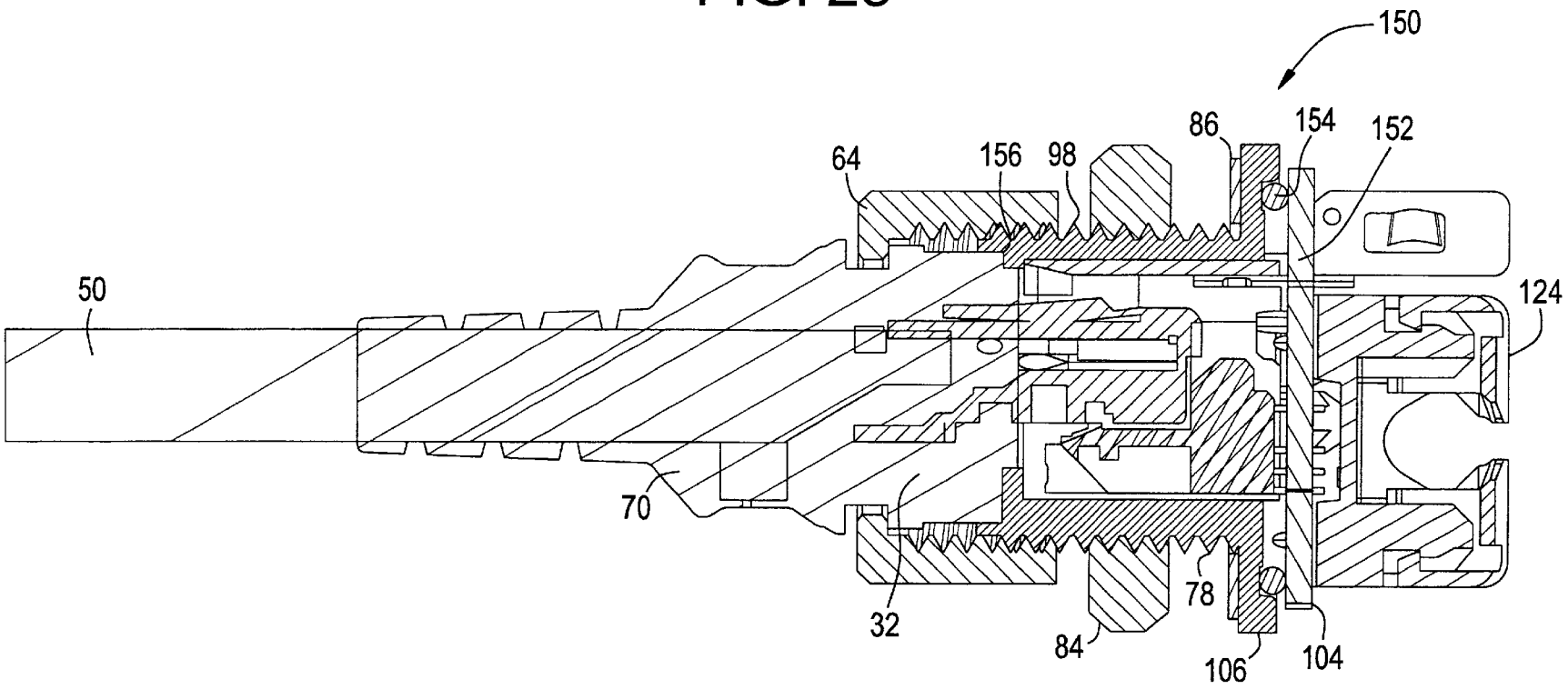
Figure 29A:
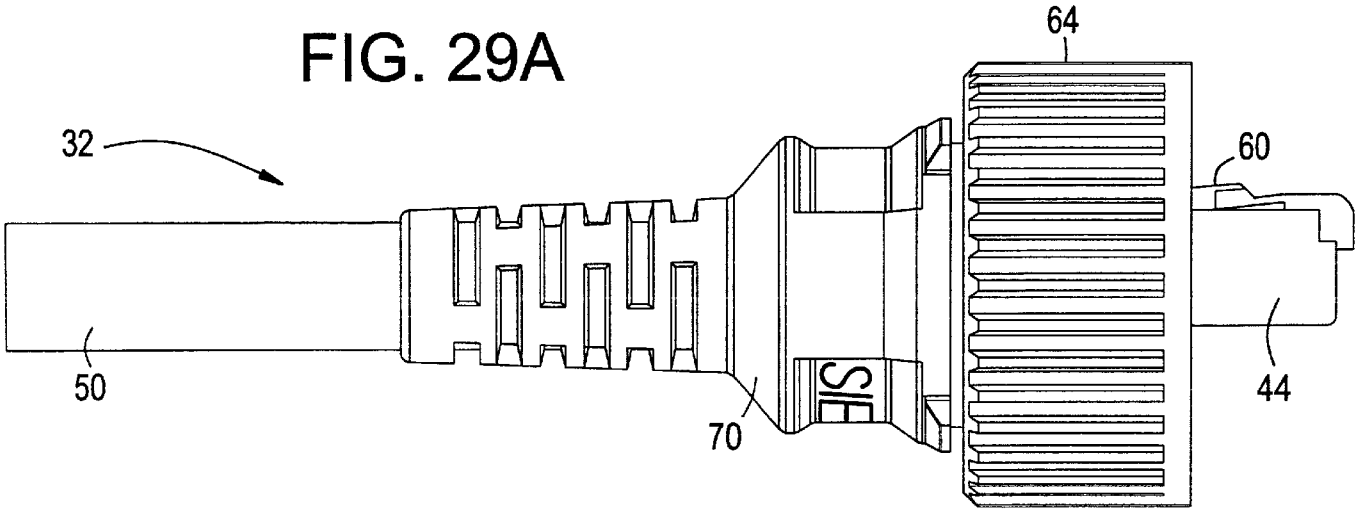
FIGS. 29A–29B are various views of a plug assembly of the industrial telecommunications connector of FIGS. 26–28.
Figure 29B:
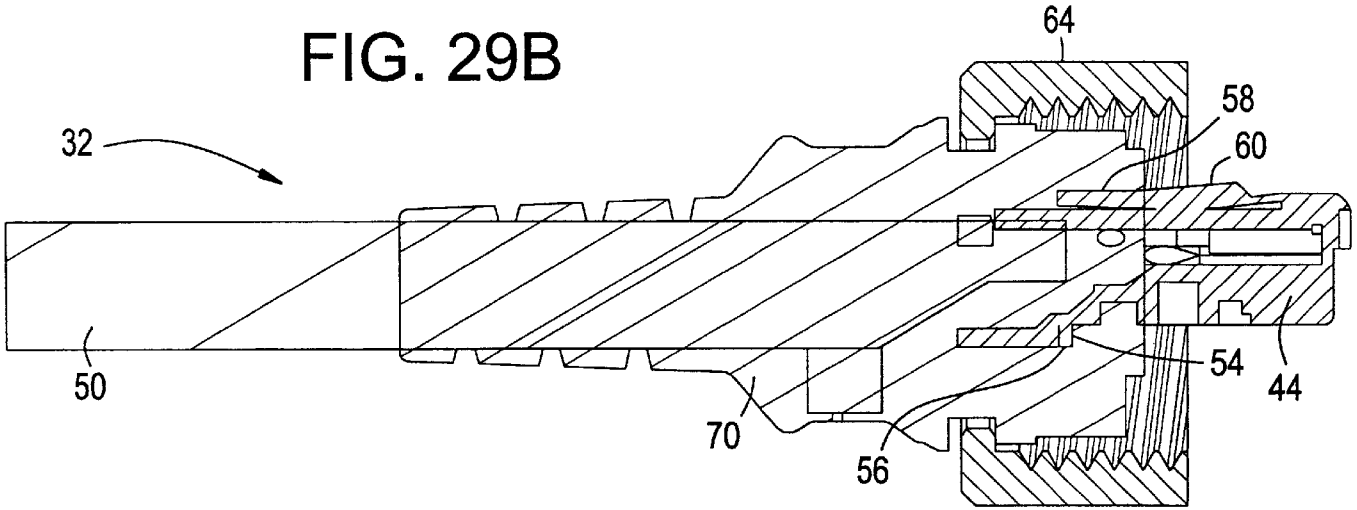
Figure 30A:
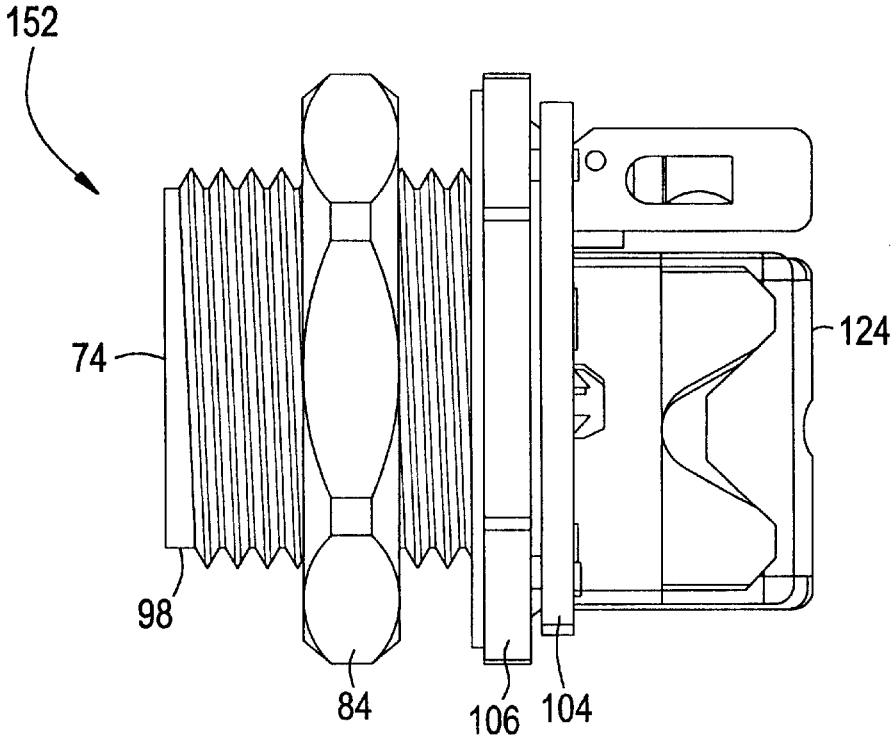
FIGS. 30–31 are various views of a jack assembly of the industrial telecommunications connector of FIGS. 26–28.
Figure 30B:
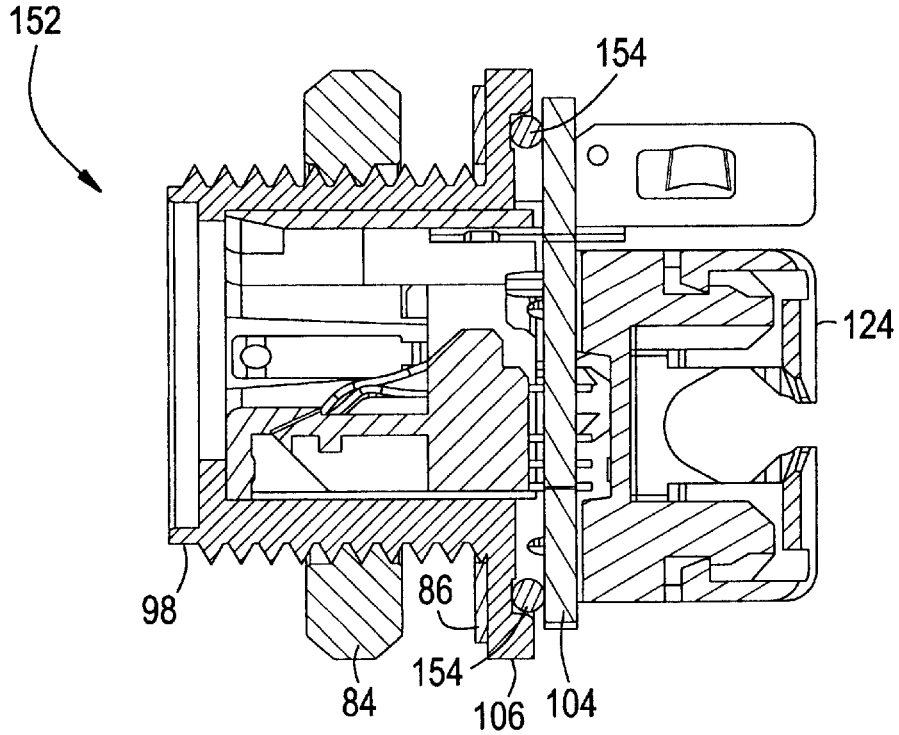
Figure 31:
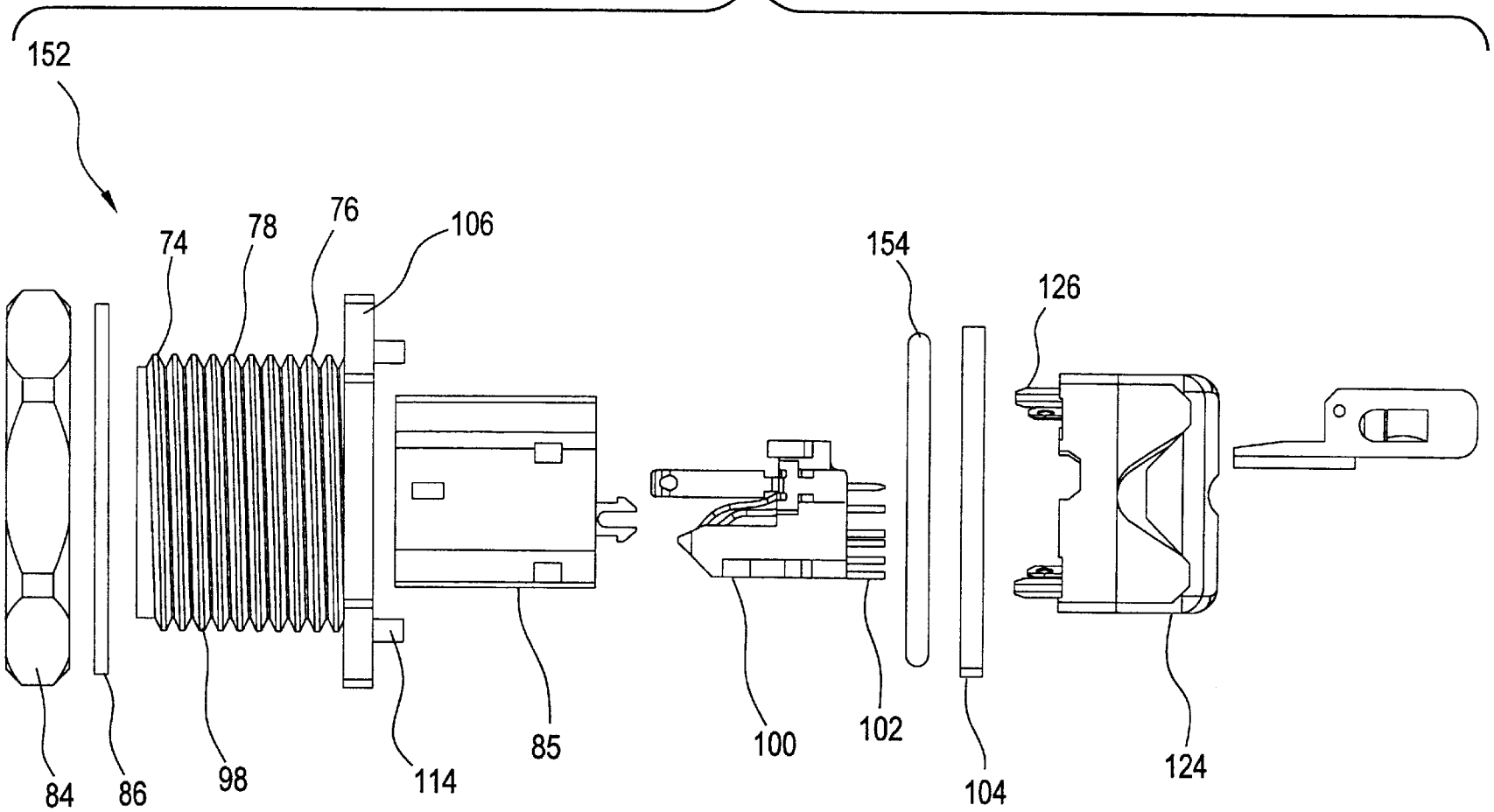
Figure 32:
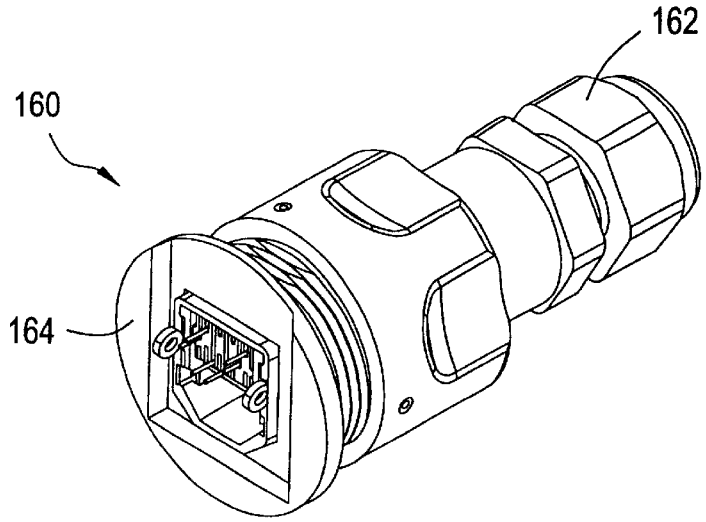
FIGS. 32–34 are various views of another embodiment of a industrial telecommunications connector.
Figure 33A:
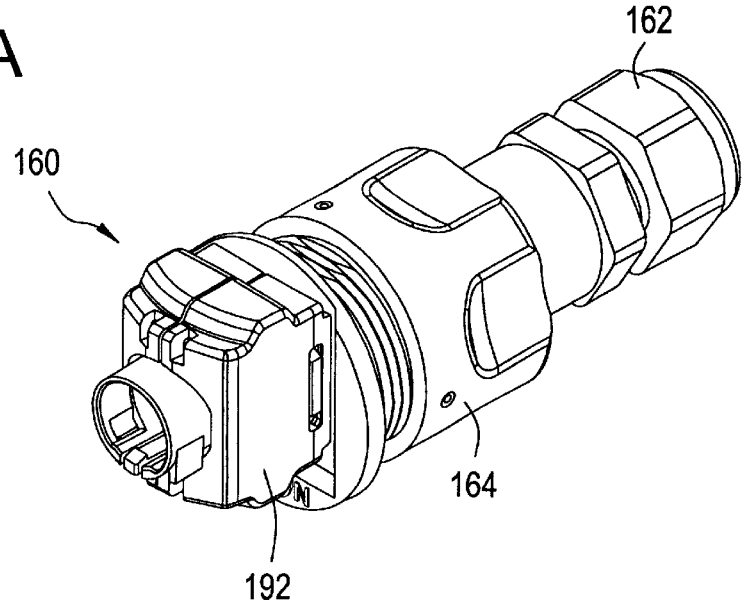
Figure 33B:
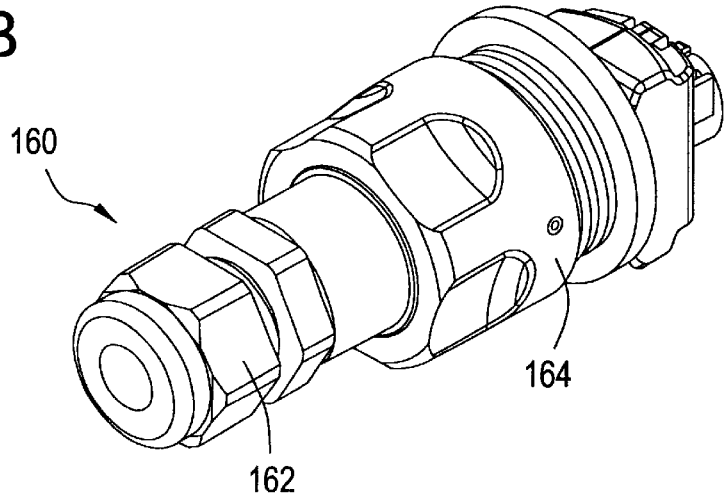

The O-ring 154 has a diameter suitable for a given application and, in one embodiment, has a diameter equivalent to a diameter of the PCB 104. A cross-section of the O-ring may be circular, as shown in FIG. 28, or alternatively the O-ring 154 may have a rectilinear or any shape cross-section suitable for a particular application. The O-ring is made of a compressible material, for example, plastic.

In the industrial telecommunications connector 150, the threaded shoulder nut 64 and the modular jack housing 98 are made of a rigid material, preferably a die cast material. In this way, when the threaded shoulder nut 64 is threadingly engaged on the modular jack housing 98, the over molded strain relief housing 70 is compressed at cut-outs 156, as shown in FIG. 28. Cut-outs 156 are recessed portions of the front end 74 of the modular jack housing 98 formed so as to receive the strain relief housing 70 and provide a surface against which the strain relief housing 70 may be compressed. Compression of the strain relief housing 70 at cut-outs 156 forms a seal which prevents undesirable substances from entering the connector 150.

FIGS. 32–43 show another embodiment of the industrial telecommunications connector of the present invention, generally indicated by reference number 160. Here again, similar elements of various embodiments of the invention are indicated by similar reference numerals.

The industrial telecommunications connector 160 includes a plug assembly 162 and a jack assembly 164 which mate to form the connector.

The plug assembly 162, specifically shown in FIGS. 35–39, includes a plug housing 166 having a front end 168 and an opposing rear end 170. The plug housing 166 receives and retains the modular plug 44 such that a portion of the plug 44 extends from the front end 168 of the plug housing 166. The cable 50, connected to the modular plug 44, extends from the rear end 170 of the plug housing 166.

The plug assembly 162 also includes a collar 172 disposed about the front end 168 of the plug housing 166. The collar 172 is disposed so as to be rotatable about the plug housing 166 as well as about the modular plug 44 and cable 50 which are fixed within the plug housing 166.

The plug assembly 162 includes a plug sealing element 174 disposed about the plug housing 166 in a recess 176 formed in the plug housing 166. The plug sealing element 174 is positioned between both the plug housing 166 and the collar 172. In this way, the plug sealing element 174 contacts both the plug housing 166 and the collar 172 and forms a seal therebetween when the plug assembly 162 is mated with the jack assembly 164.

On an interior 177 of the collar 172, the plug assembly 162 includes mating pins 178 extending radially inward toward a longitudinal axis of the collar or, otherwise, extending inward from the collar.

The jack assembly 164, as specifically shown in FIGS. 40–43, includes a modular jack housing 180 for receiving and retaining the modular jack 85. The modular jack housing 180 includes a bayonet portion 182 at the front end 74 and a threaded portion 184 at the rear end 76. The threaded portion 184 is for threadably receiving the locknut 84 to assist in mounting the plug assembly 164 in the connector housing 38 of FIG. 3.

The bayonet portion 182 includes grooves 186 for receiving the mating pins 178 in connecting the plug assembly 162 to the jack assembly 164. The grooves 186, in one embodiment, are helically formed in the bayonet portion. The grooves 186 have an entrance 188 and a lock position 190.

Figure 42A:
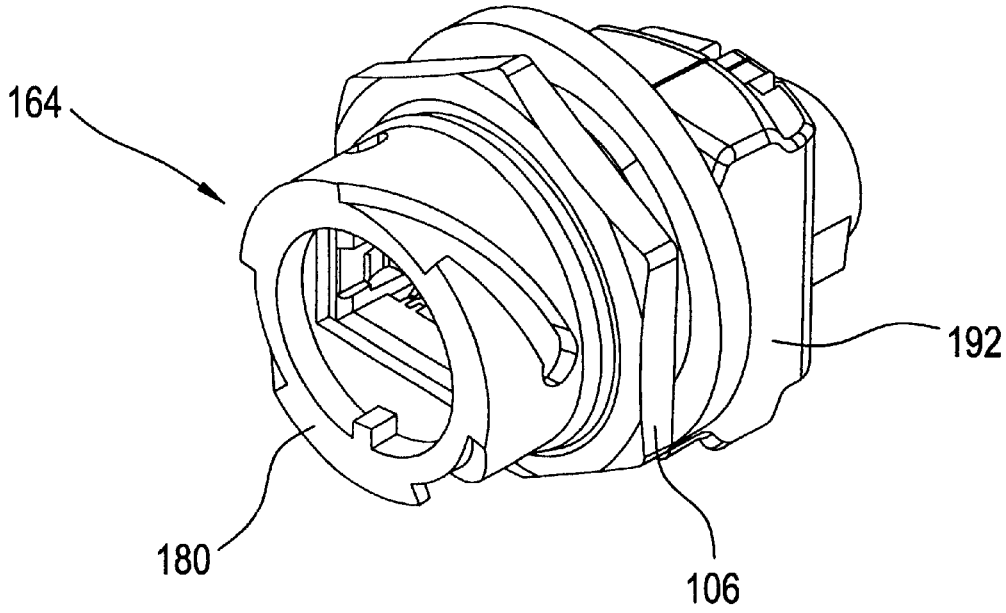
Figure 42B:
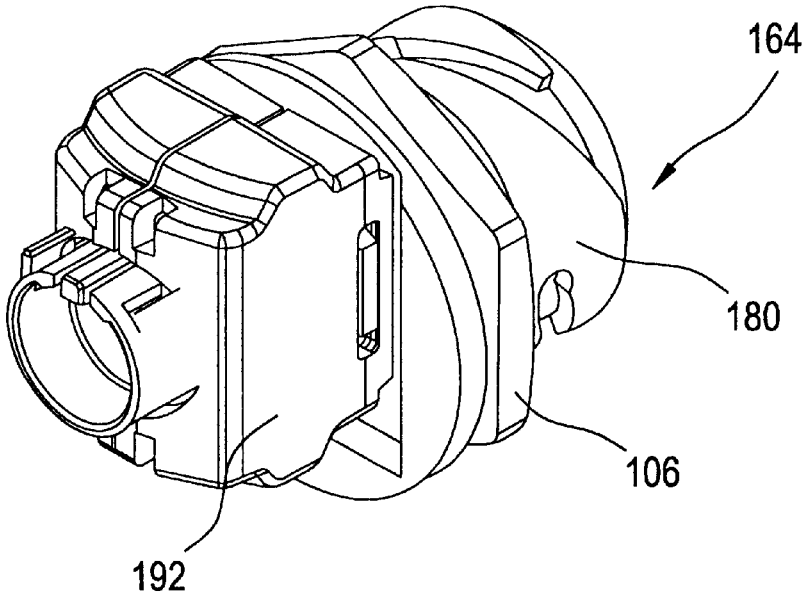
Figure 43A:
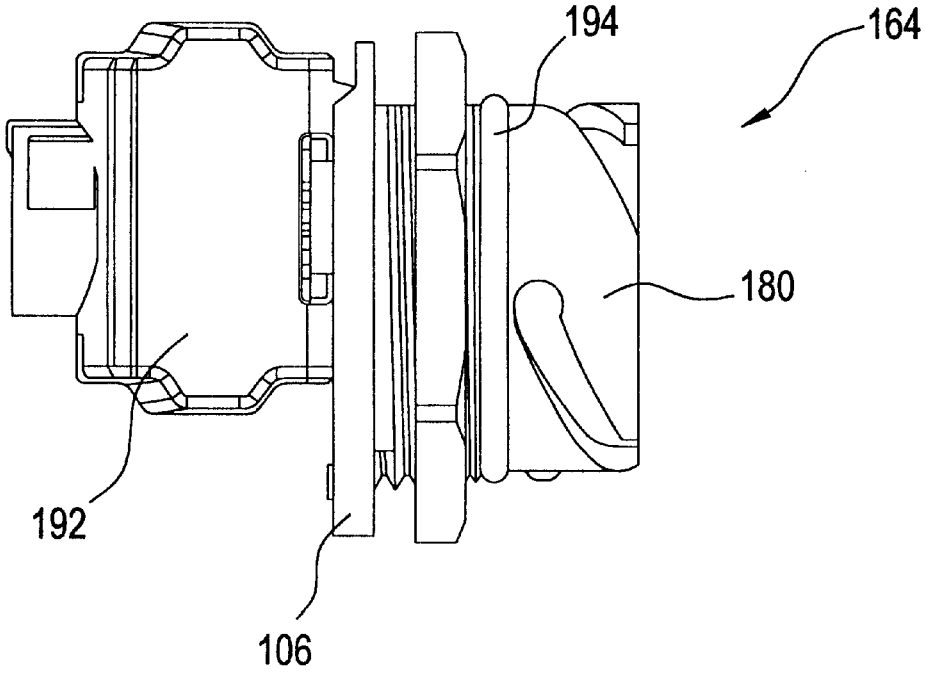
Figure 43B:
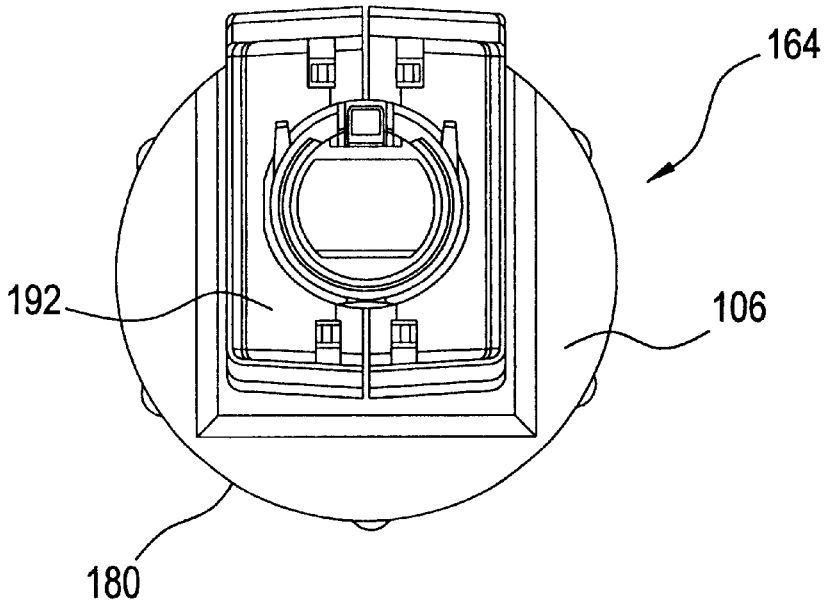

The jack assembly 164 includes, in one embodiment, a connector housing 192 as shown in FIGS. 42–43. The connector housing 192 attaches to the sealing surface 106 of the modular jack housing 180 opposite the threaded portion 184. The connector housing 192 attaches over the connector housing 100 and may contain the connecting block 124.

The jack assembly 164 also includes a jack sealing element 194. The jack sealing element 194 is disposed in a recess 195 formed in the modular jack housing 180, preferably, in the bayonet portion 182 proximate the threaded potion 184.

The jack sealing element 194 is positioned so as to form a seal between the plug assembly 162 and the jack assembly 164 when mated to form the industrial telecommunications plug 160. When the plug assembly 162 and the jack assembly 164 are mated, the jack sealing element 194 is compressed therebetween forming a seal to prevent passage of undesirable substances and/or elements. The jack sealing element 194 is of a compressible material and, in one embodiment, is made of plastic or rubber.

The jack sealing element 194 is compressed and forms the seal by being slightly oversized and being positioned to contact both the modular jack housing 180 and the collar 172 as the plug assembly 162 is mated with the jack assembly 164. The jack sealing element 194 traverses a perimeter of the modular jack housing 180 and contacts the collar 172 continuously along a corresponding perimeter.

The plug assembly 162 and the jack assembly 164 are mated to form the industrial telecommunications plug 160 by engaging the collar 172 and the bayonet portion 182. The grooves 186, at the entrance 188, slidably receive the mating pins 178 of the collar 172. The mating pins 178 traverse the grooves 186 causing translation and rotation of the collar 172 with respect to the modular jack housing 180. When the mating pins 178 slidably engage the lock position 190, the pins are held secure by a receiving portion 196.

When the mating pins 178 securingly engage the lock position 190, the plug assembly 162 is fully mated with the jack assembly 164, thus forming the industrial telecommunications plug 160. Here, the collar 172 fully contacts the jack sealing element 194, thus forming the seal between the collar 172 and the modular jack housing 180. Also, when the mating pins 178 securingly engage the lock position 190, the plug sealing element 174 is compressed between the plug housing 166 and the collar 172, thus forming the seal therebetween discussed above.

When the plug assembly 162 and the jack assembly 164 engage to for the industrial telecommunications connector 160, the plug sealing element 174 and the jack sealing element 194 each provide a seal to prevent passage of undesirable substances and/or elements. Specifically, the plug sealing element 174 and the jack sealing element 194 prevent undesirables from entering an interior of the collar 172 and the grooves 186 of the bayonet portion 182. This prevents debris from accumulating in the grooves 186 thus allowing proper sliding engagement of the mating pins 178.

Figure 34A:
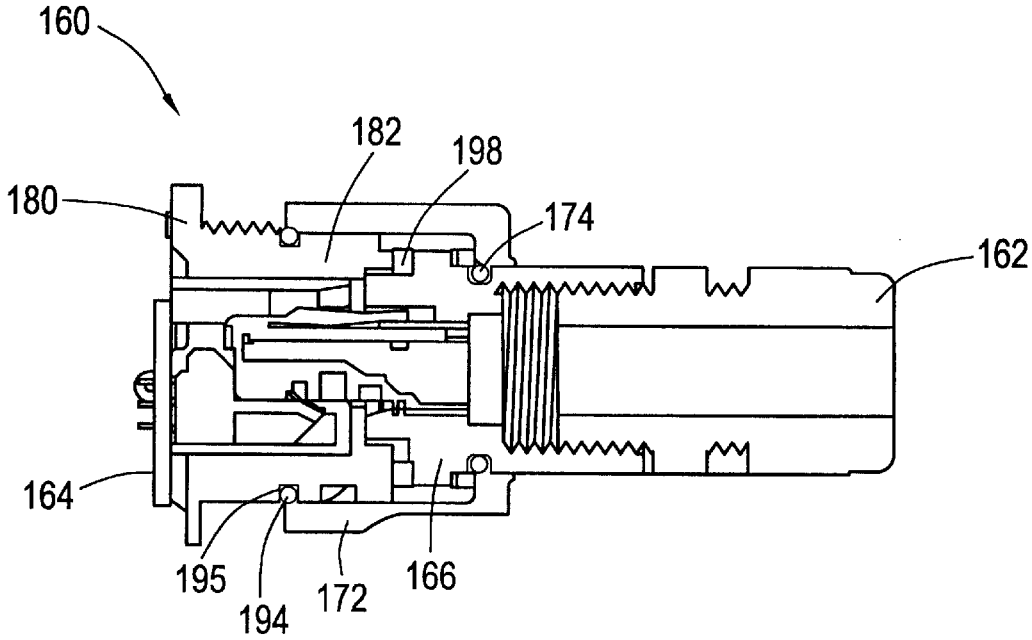
Figure 39:
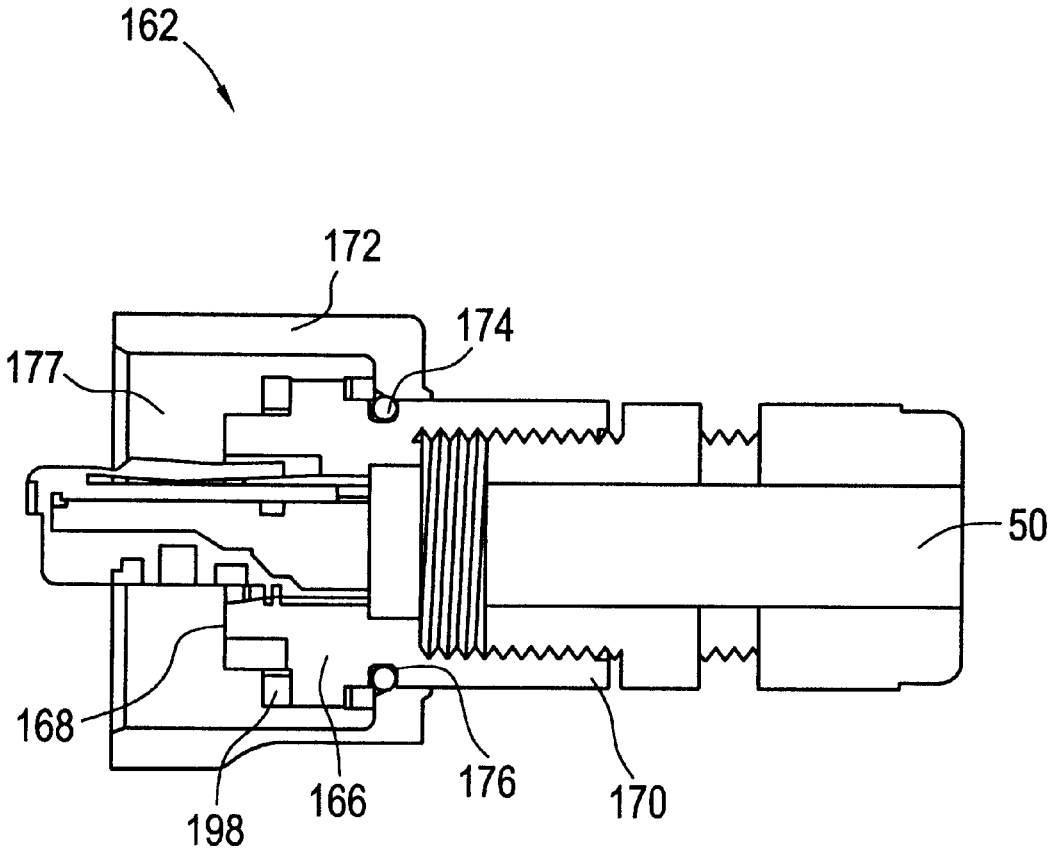
Figure 40A:
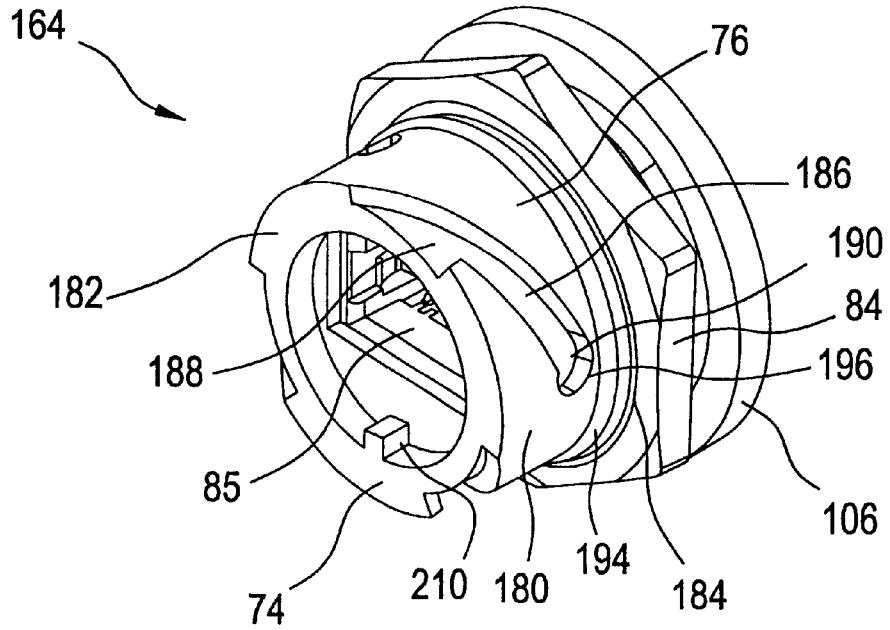
FIGS. 40–43 are various views of a jack assembly of the industrial telecommunications connector of FIGS. 32–34.
Figure 40B:
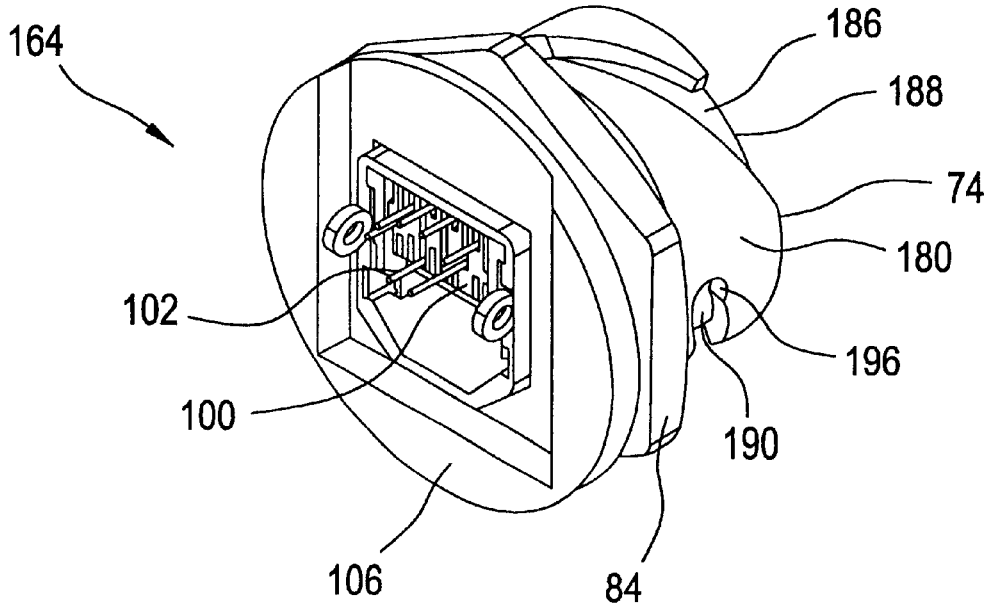
Figure 41A:
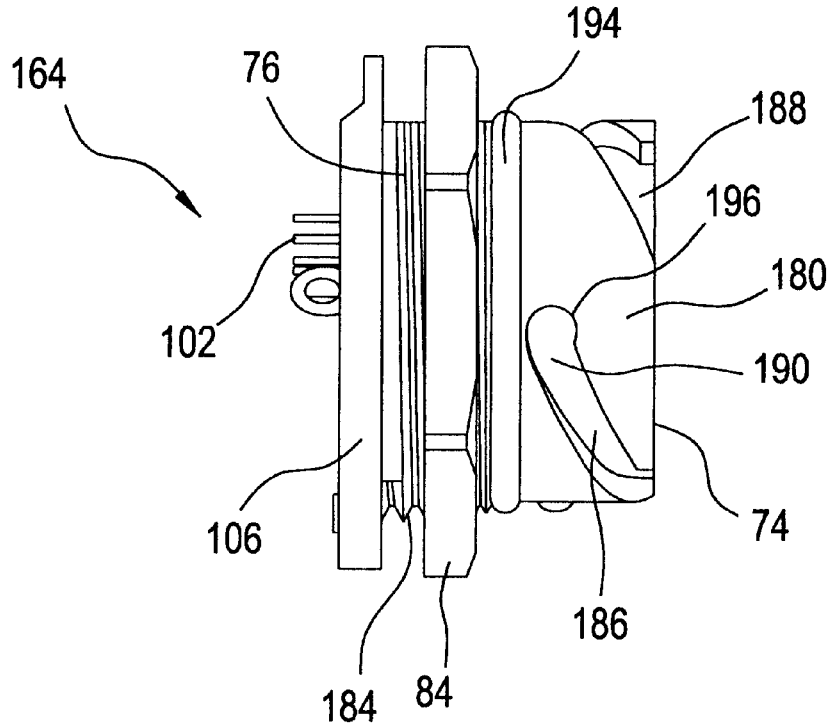
Figure 41B:
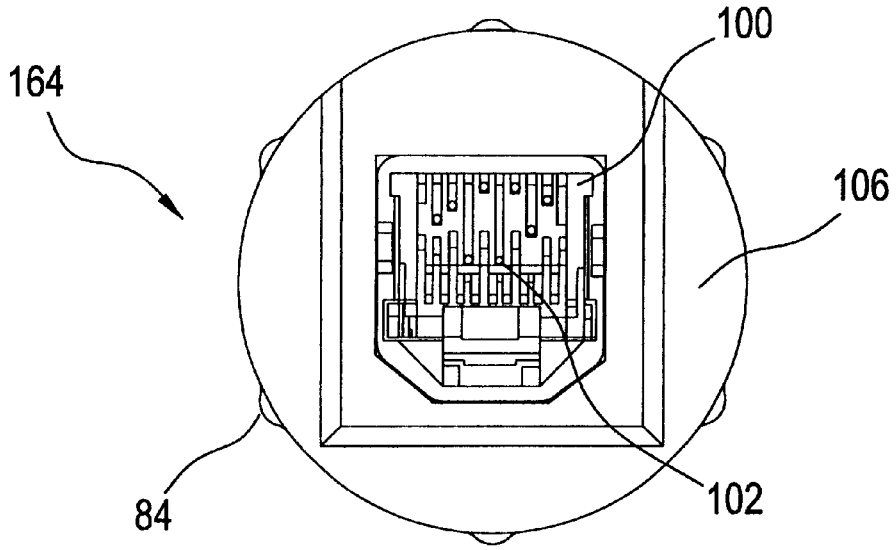

The industrial telecommunications connector 160 further includes a connector sealing element 198 positioned on the plug housing 166 at the front end 168, as particularly shown in FIGS. 34 and 39. The connector sealing element 198 is a compressible member which extends about a longitudinal access of the plug housing 166. The modular plug 44 extends through the connector sealing element 198.

When the plug assembly 162 engages the jack assembly 164 to form the industrial telecommunications plug 160, the connector sealing element 196 is compressed between the plug housing 166 and the bayonet portion 182 of the modular jack housing 180. Compression of the connector sealing element 196 forms a seal between the plug assembly 162 and the jack assembly 164 which prevents passage of undesirable substances and/or elements. In this way, the modular plug 44 and the modular jack 85 and the connective elements thereof are protected from exposure to the environment outside the industrial telecommunications connector 160.

The feature of mating the plug assembly 162 and the jack assembly 164 by engaging the bayonet portion 182 and the mating pins 178, as described above, is particularly advantageous because of the ease and consistency of assembling the industrial telecommunications plug 160. The bayonet engagement allows simple assembly over common threading techniques. Additionally, the bayonet engagement allows the plug assembly 162 and the jack assembly 164 to be optimally positioned every time the assemblies are mated. That is, when the mating pins 178 properly engage the receiving portion 196 at the lock position 190, the plug 44 is optimally positioned within the jack 85 to establish connectivity. Additionally, when the mating pins 178 are at the lock position 190, an optimal pressure is exerted on the plug sealing element 174, the jack sealing element 194, and the connector sealing element 196, thus establishing consistent and effective seals between the relative parts of the industrial telecommunications connector 160.

Figure 34B:
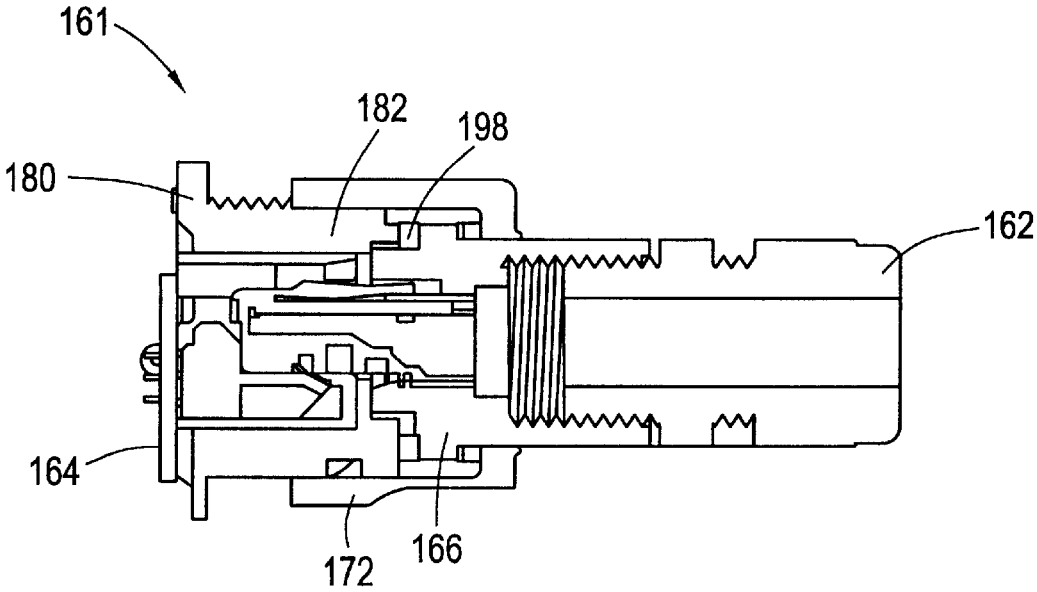
Figure 35:
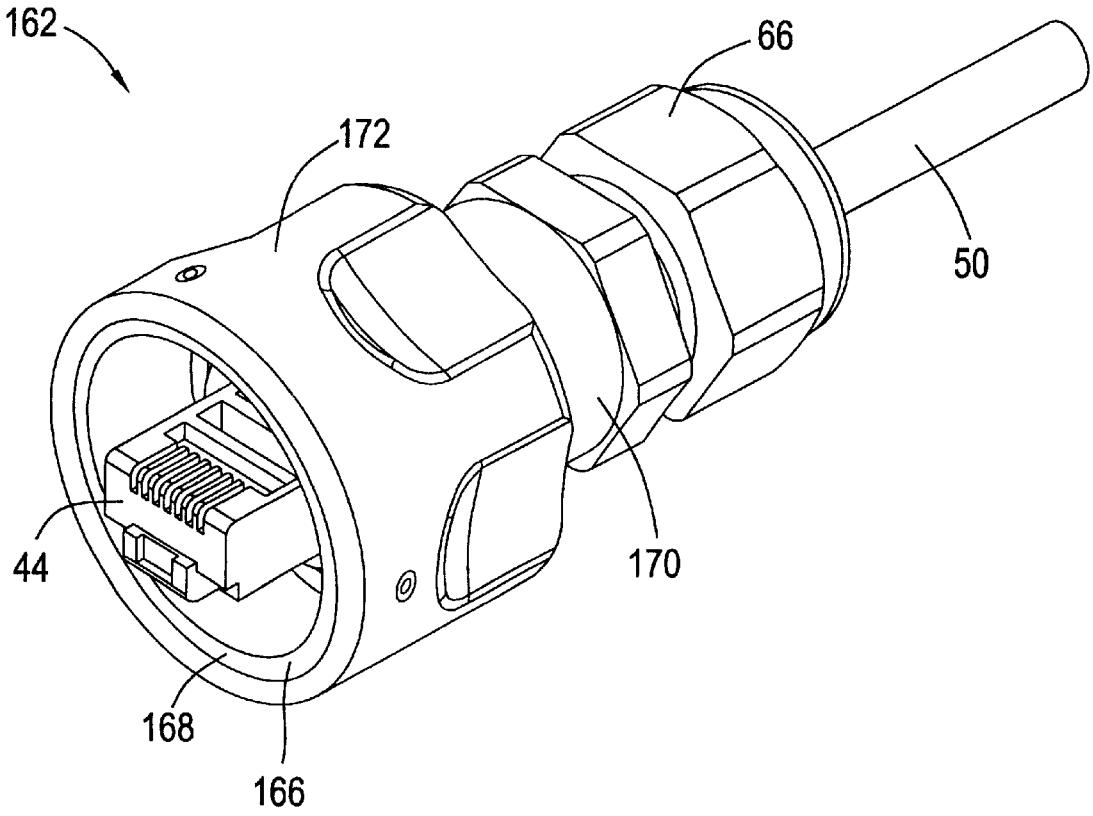
FIGS. 35–39 are various views of a plug assembly of the industrial telecommunications connector of FIGS. 32–34.
Figure 36:
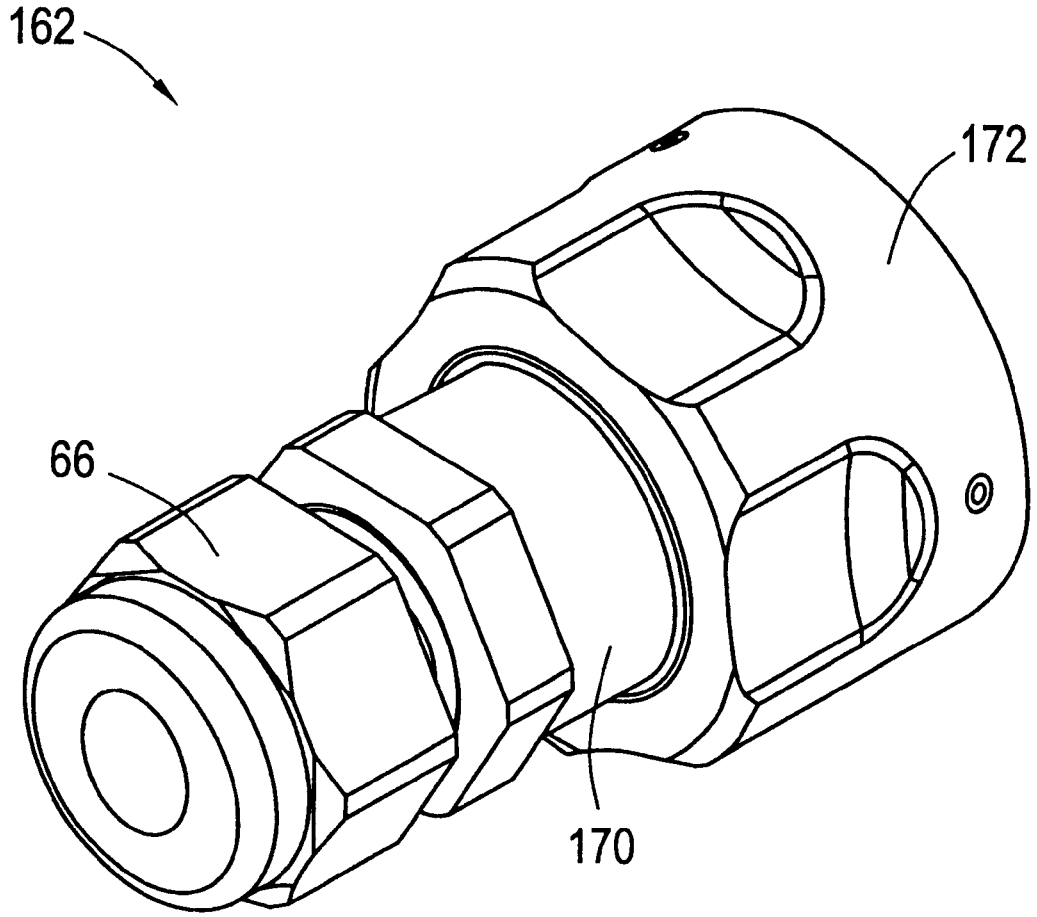
Figure 37:
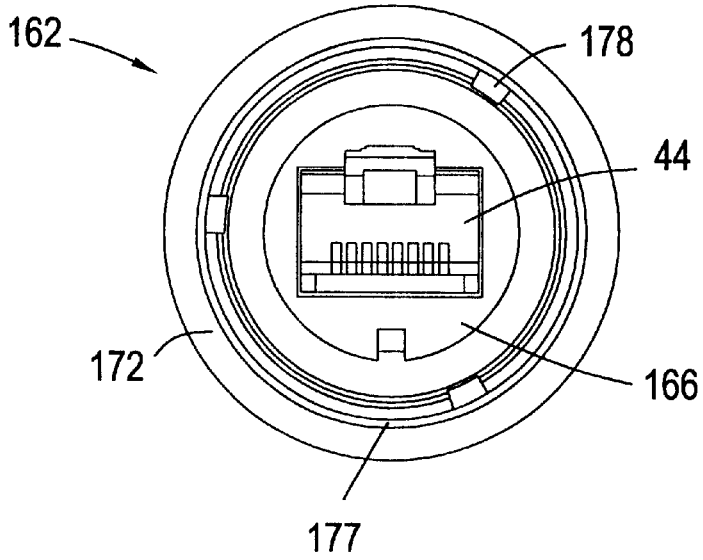
Figure 38:
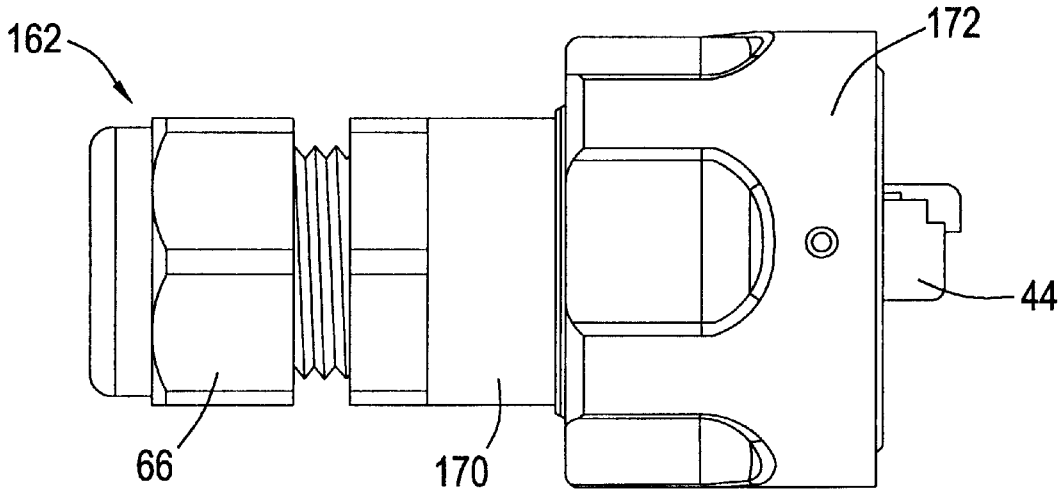

FIG. 34B shows another embodiment of the industrial telecommunications connector of the invention, generally indicated by reference numeral 161. The industrial telecommunications connector 161 is similar to the connector 160 except that the connector 161 does not include the plug sealing element 174 and the jack sealing element 194 nor the corresponding recesses 176, 195, respectively. The connector 161 does include the connector sealing element 198. As discussed above, when the plug assembly is engaged with the jack assembly, the connector sealing element 198 provides a seal to the plug and the jack against exposure to degrading elements and/or substances. In the industrial telecommunications connector 161, the connector sealing element 198 provides this seal, protecting the plug and jack and ensure the integrity of the connection thereof.

The industrial connector 161 is particularly advantageous because the plug and jack are effectively sealed and protected by the use of only one sealing element, that being sealing element 198. This reduces parts required for the connector 161, simplifies assembly and maintenance, and minimizes overall costs.

Referring again to FIGS. 37 and 40A, the jack assembly 164 further includes an anti-rotation key 210 formed at the front end 74. The plug assembly 162 includes a key opening 212 formed in the plug housing 166. The key opening 212 corresponds in size to the anti-rotation key 210. The key opening 212 also corresponds to the disposition of the plug assembly 162 and the jack assembly 164 when mating the plug 44 and the jack 85.

When engaging the plug assembly 162 and the jack assembly 164, the anti-rotation key 210 is received by the key opening 212 and thus prevents rotational movement of the plug 44 relative to the jack 85. The collar 172 continues to be rotatable about the plug housing 166 and may be engaged with the jack assembly as discussed above. However the plug 85 and the plug housing are not rotatable relative the jack assembly 164 when the key opening 212 receives the anti-rotation key 210. This is particularly advantageous because it prevents undesired rotational movement of the plug as the plug enters and mates with the jack. Such undesired rotational movement often misaligns the various contacts of the plug and jack and/or damages the plug and jack.

It will be understood that a person skilled in the art may make modifications to the preferred embodiment shown herein within the scope and intent of the claims. While the present invention has been described as carried out in specific embodiments thereof, it is not intended to be limited thereby but is intended to cover the invention broadly within the scope and spirit of the claims.

What is claimed is:

1. A telecommunications connector comprising:

a plug assembly including a plug housing having a plug, a first mating device, and a first seal member, wherein the plug includes a latching member for latching with a jack, wherein the plug assembly further includes a latch defeat that retains the latching member in a position to prevent said latching with the jack, and a jack assembly including a jack housing including the jack and a second mating device, wherein the first mating device and the second mating device are engageable such that, when engaged, the jack receives the plug and the first sealing member forms a first seal between the plug assembly and the jack assembly.

2. The telecommunications connector of claim 1, wherein the first mating device is a threaded collet and the second mating device is a threaded portion of the jack assembly and the first sealing member is compressed as the threaded collet engages the threaded portion.

3. The telecommunications connector of claim 1, wherein the plug assembly and the jack assembly are keyed to be engaged in one direction.

4. The telecommunications connector of claim 1, wherein contacts of the jack protrude from the jack housing at a first end and make electrical contact with a printed circuit board, the jack assembly further comprising a second seal member disposed between the printed circuit board and the first end, the second seal member forming a second seal around the contacts and between the first end and the printed circuit board.

5. The telecommunications connector of claim 4, wherein the second seal member includes compressible raised portions formed on a first side, and a second side being opposite the first side, the second seal being formed by compressed raised portions between the first side and the printed circuit board and between the second side and the jack housing.

6. The telecommunications connector of claim 1, wherein the first mating device comprises a mating pin and the second mating device comprises a spiral mating groove formed in a portion of the jack housing, the spiral mating groove slidably receiving the mating pin to engage the plug assembly and the jack assembly.

7. The telecommunications connector of claim 1, further comprising:

a second seal member disposed in a plug groove formed in the plug housing; and, a third seal member disposed in a jack groove formed in the jack housing;

wherein the second seal member forms a second seal between the plug housing and the first mating device, and the third seal member forms a third seal between the jack housing and the first mating device.

8. The telecommunications connector of claim 7 wherein the second seal member and the third seal member are compressible annular members.

9. The telecommunications connector of claim 1 wherein the plug is an RJ-45 plug and the jack is an RJ-45 jack.

10. The telecommunications connector of claim 1 further comprising a cable connected to the plug, wherein the cable is a wire cable.

11. A telecommunications connector comprising:

a plug assembly including a plug housing having a plug, a first mating device, and a first seal member disposed in a plug groove formed in the plug housing, wherein the plug includes a latching member for latching with a jack, wherein the plug assembly further includes a latch defeat that retains the latching member in a position to prevent said latching with the jack; and a jack assembly including a jack housing including the jack, a second mating device, and a second seal member disposed in a jack groove formed in the jack housing;

wherein the first mating device and the second mating device are engageable such that, when engaged, the jack receives the plug, and;

wherein the first seal member forms a first seal between the plug housing and the first mating device, and the second seal member forms a second seal between the jack housing and the first mating device.

12. The telecommunications connector of claim 11, wherein the first mating device is a threaded collet and the second mating device is a threaded portion of the jack assembly.

13. The telecommunications connector of claim 11, wherein the plug assembly and the jack assembly are keyed to be engaged in one direction.

14. The telecommunications connector of claim 11, wherein contacts of the jack protrude from the jack housing at a first end and make electrical contact with a printed circuit board, the jack assembly further comprising a third seal member disposed between the printed circuit board and the first end, the third seal member forming a third seal around the contacts and between the first end and the printed circuit board.

15. The telecommunications connector of claim 14, wherein the third seal member includes compressible raised portions formed on a first side, and a second side being opposite the first side, the second seal being formed by compressed raised portions between the first side and the printed circuit board and between the second side and the jack housing.

16. The telecommunications connector of claim 11, wherein the first mating device comprises a mating pin and the second mating device comprises a spiral mating groove formed in a portion of the jack housing, the spiral mating groove slidably receiving the mating pin to engage the plug assembly and the jack assembly.

17. The telecommunications connector of claim 11 wherein the first seal member and the second seal member are compressible annular members.

18. The telecommunications connector of claim 11 wherein the plug is an RJ-45 plug and the jack is an RJ-45 jack.

19. The telecommunications connector of claim 11 further comprising a cable connected to the plug, wherein the cable is a wire cable.

* * * * *

UNITED STATES PATENT AND TRADEMARK OFFICE

CERTIFICATE OF CORRECTION

PATENT NO. : 6,595,791 B2
APPLICATION NO. : 10/208345
DATED : July 22, 2003
INVENTOR(S) : Randy J. Below et al.

It is certified that error appears in the above-identified patent and that said Letters Patent is hereby corrected as shown below:

Title Page,

Item [56], delete "3,816,664" and insert therefor -- 3,816,641 --.

Signed and Sealed this

Fifth Day of June, 2007

JON W. DUDAS
*Director of the United States Patent and Trademark Office*